US009822781B2

(12) United States Patent
Swartzlander

(10) Patent No.: US 9,822,781 B2
(45) Date of Patent: Nov. 21, 2017

(54) OPTIMIZED HELIX ANGLE ROTORS FOR ROOTS-STYLE SUPERCHARGER

(71) Applicant: Eaton Corporation, Cleveland, OH (US)

(72) Inventor: Matthew G. Swartzlander, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 213 days.

(21) Appl. No.: 14/577,968

(22) Filed: Dec. 19, 2014

(65) Prior Publication Data

US 2015/0118086 A1 Apr. 30, 2015

Related U.S. Application Data

(60) Provisional application No. 61/919,343, filed on Dec. 20, 2013.

(51) Int. Cl.

| | |
|---|---|
| ***F01C 1/18*** | (2006.01) |
| ***F04C 29/12*** | (2006.01) |
| ***F04C 18/08*** | (2006.01) |
| ***F04C 18/16*** | (2006.01) |
| ***F04C 18/18*** | (2006.01) |
| ***F04C 29/06*** | (2006.01) |
| ***F04C 18/12*** | (2006.01) |

(52) U.S. Cl.

CPC ..... *F04C 29/12* (2013.01); *F04C 18/084* (2013.01); *F04C 18/088* (2013.01); *F04C 18/126* (2013.01); *F04C 18/16* (2013.01); *F04C 18/18* (2013.01); *F04C 29/068* (2013.01)

(58) Field of Classification Search

CPC .... F04C 18/084; F04C 18/088; F04C 18/126; F04C 18/16; F04C 18/18; F04C 29/068; F04C 29/12

See application file for complete search history.

(56) References Cited

U.S. PATENT DOCUMENTS

| | | | | |
|---|---|---|---|---|
| 1,719,025 | A * | 7/1929 | Scheminger, Jr. ..... | F04C 2/088 418/189 |
| 1,746,885 | A | 2/1930 | Bunge et al. | |
| 2,014,932 | A | 9/1935 | Hallett | |
| 2,028,414 | A | 1/1936 | Schneider | |
| 2,048,249 | A | 7/1936 | Elwert | |
| 2,078,334 | A | 4/1937 | Martocello | |
| 2,259,027 | A | 10/1941 | De Zarate et al. | |
| 2,448,901 | A | 9/1948 | McCulloch et al. | |
| 2,454,048 | A | 11/1948 | Flanagan | |
| 2,463,080 | A | 3/1949 | Beier | |

(Continued)

FOREIGN PATENT DOCUMENTS

| | | |
|---|---|---|
| GB | 676839 | 8/1952 |

*Primary Examiner* — Jesse Bogue

(74) *Attorney, Agent, or Firm* — Fishman Stewart PLLC

(57) ABSTRACT

A Roots-type blower may include first and second meshed, lobed rotors disposed in first and second chambers of a housing. Each lobe may have first and second axially facing end surfaces defining a twist angle that may be a function, at least partially, of the number of lobes on each rotor. A blower housing may include a bearing plate that may include one or more internal pressure relief ports. A pressure relief port may be configured to relieve fluid pressure from a trapping area that may form between first and second meshed rotors.

18 Claims, 20 Drawing Sheets

(56) References Cited

U.S. PATENT DOCUMENTS 2,480,818 A 8/1949 Whitfield
2,547,169 A 4/1951 Paget
2,654,530 A 10/1953 Oldberg
2,691,482 A 10/1954 Ungar
2,906,448 A 9/1959 Lorenz
3,058,652 A 10/1961 Glamann
3,121,529 A 2/1964 Hubrich
3,151,806 A 10/1964 Whitfield
3,303,792 A * 2/1967 Littlewood ..... F04C 2/088 418/189
3,531,227 A 9/1970 Weatherston
3,667,874 A 6/1972 Weatherston et al.
3,787,154 A 1/1974 Edstrom
3,844,695 A 10/1974 Weatherston
3,986,801 A 10/1976 Garland
4,042,062 A 8/1977 Tooley
4,135,602 A 1/1979 Clark
4,210,410 A 7/1980 Ohtani
4,215,977 A 8/1980 Weatherston
4,329,130 A 5/1982 Nagata et al.
4,556,373 A * 12/1985 Soeters, Jr. ..... F04C 18/088 418/189
4,560,333 A 12/1985 Fujiwara et al.
4,569,646 A * 2/1986 Soeters, Jr. ..... F04C 18/088 418/189
4,609,329 A 9/1986 Pillis et al.
4,609,335 A 9/1986 Uthoff, Jr.
4,643,655 A 2/1987 Uthoff, Jr.
4,768,934 A 9/1988 Soeters, Jr.
5,078,583 A 1/1992 Hampton et al.
5,083,907 A 1/1992 Brownell
5,090,879 A * 2/1992 Weinbrecht ..... F04C 29/122 418/15
5,118,268 A * 6/1992 Crisenbery ..... F04C 29/12 418/189
5,131,829 A * 7/1992 Hampton ..... F04C 29/0035 418/189
5,527,168 A * 6/1996 Juday ..... F01C 21/10 418/201.1
5,979,168 A 11/1999 Beekman
6,884,050 B2 4/2005 Prior
7,488,164 B2 2/2009 Swartzlander
7,726,285 B1 6/2010 Hansen et al.
7,866,966 B2 1/2011 Swartzlander
8,096,288 B2 * 1/2012 Ouwenga ..... F04C 18/12 123/559.1
8,512,018 B2 * 8/2013 Jordan ..... F04C 2/088 418/189
8,632,324 B2 1/2014 Swartzlander
2012/0093671 A1 * 4/2012 Upton ..... F04C 18/16 418/1

* cited by examiner 11
15
21
19
13
23
25
17

OPTIMIZED HELIX ANGLE ROTORS FOR ROOTS-STYLE SUPERCHARGER

RELATED APPLICATIONS

This application claims the benefit of U.S. Provisional Patent Application 61/919,343, filed Dec. 20, 2013, the entire disclosure of which is hereby incorporated by reference herein as though fully set forth in its entirety. The following applications are hereby incorporated by reference in their entireties: U.S. patent application Ser. No. 14/158,163, U.S. Pat. No. 8,632,324, U.S. Pat. No. 7,866,966 and U.S. Pat. No. 7,488,164.

BACKGROUND

The present teachings relate to Roots-type blowers, and more particularly, to such blowers in which the lobes are not straight (e.g., parallel to the axis of the rotor shafts), but instead are "twisted" to define a helix angle.

Roots-type blowers may be used for moving volumes of air in applications such as boosting or supercharging vehicle engines. A Roots-type blower supercharger may be configured to transfer, into the engine combustion chambers, volumes of air which are greater than the displacement of the engine, thereby raising ("boosting") the air pressure within the combustion chambers to achieve greater engine output horsepower. The present disclosure is not limited to a Roots-type blower for use in engine supercharging, but will be described in connection therewith for illustrative purposes.

In some configurations, a Roots-type blower may include two rotors each having two straight lobes. In other configurations, Roots-type blowers may include three lobes and the lobes may be twisted. In some configurations, a Roots-type blower may include two identical rotors, wherein the rotors may be arranged so that, as viewed from one axial end, the lobes of one rotor are twisted clockwise, while the lobes of the meshing rotor are twisted counterclockwise. Twisted lobes on the rotors of a blower may result in a blower having significantly better air handling characteristics, which may include producing significantly less air pulsation and turbulence.

An example of a Roots-type blower is shown in U.S. Pat. No. 2,654,530, assigned to the assignee of the present invention and incorporated herein by reference in its entirety. Some Roots-type blowers, which may be used as vehicle engine superchargers, may be of a "rear inlet" and/or "axial inlet" type, e.g., a supercharger may mechanically driven by means of a pulley that may be disposed toward the front end of the engine compartment while the air inlet to the blower is disposed at the opposite end, e.g., toward the rearward end of the engine compartment. In some Roots-type blowers, the air outlet may be formed in a housing wall, such that the direction of air flow as it flows through the outlet may be radial relative to the axis of the rotors. Such blowers may be referred to as being of the "axial inlet, radial outlet" type. It should be understood that the present disclosure is not limited to use in the axial inlet, radial outlet type, but will be described in connection therewith for example only.

Another example of a Roots-type blower is shown in U.S. Pat. No. 5,078,583, also assigned to the assignee of the present invention and incorporated herein by reference in its entirety. Roots-type blowers of the "twisted lobe" type may include an outlet port that is generally triangular, and the apex of the triangle may disposed in a plane containing an outlet cusp defined by the overlapping rotor chambers. Typically, angled sides of the triangular outlet port define an angle which is substantially equal to the helix angle of the rotors (e.g., the helix angle at the lobe O.D.), such that each lobe, in its turn, passes by the angled side of the outlet port in a "line-to-line" manner. In accordance with the teachings of the above-incorporated U.S. Pat. No. 5,078,583, some Roots-type blowers include a backflow slot on either side of the outlet port to provide for backflow of outlet air to transfer control volumes of air trapped by adjacent unmeshed lobes of the rotor, just prior to traversal of the angled sides of the outlet port. The present disclosure is not limited to use with a blower housing having a triangular outlet port in which the angle defined by the angled side corresponds to the helix angle of the rotors, but will be described in connection therewith for example only.

Roots-type blowers may include overlapping rotor chambers, with the locations of overlap defining what are typically referred to as a pair of "cusps." An "inlet cusp" may refer to the cusp adjacent the inlet port and the term "outlet cusp" may refer to the cusp which is interrupted by the outlet port. It should be understood that references to a "helix angle" of the rotor lobes may include the helix angle at the pitch circle of the lobes.

In examples of the present teachings, a Roots-type blower may include a "seal time" wherein the reference to "time" may actually be an angular measurement (e.g., in rotational degrees). Therefore, "seal time" may refer to the number of degrees that a rotor lobe (or a control volume) travels in moving through a particular "phase" of operation, as the various phases will be described hereinafter. In examples of the present teachings, a lobe separation may include the number of degrees between adjacent lobes. In some configurations, for a Roots-type blower having three lobes, the lobe separation (L.S.) may be represented by the equation: L.S.=360/N and with N=3, the lobe separation L.S. may be 120 degrees. A Roots-type blower may include four phases of operation, and for each phase there may be an associated seal time as follows: (1) an "inlet seal time," which may include the number of degrees of rotation during which the control volume is exposed to the inlet port; (2) a "transfer seal time," which may include the number of degrees of rotation during which the transfer volume is sealed from both the inlet "event" and the backflow "event"; (3) a "backflow seal time," which may include the number of degrees during which the transfer volume is open to a backflow port, prior to discharging to the outlet port; and (4) an "outlet seal time," which may include the number of degrees during which the transfer volume is exposed to the outlet port.

Another parameter of a Roots-type blower may include a twist angle of each lobe (e.g., angular displacement, in degrees), which may occur in "traveling" from the rearward end of the rotor to the forward end of the rotor. In some configurations, a Roots-type blower may include a particular twist angle and that angle may be utilized in designing and developing subsequent blower models. By way of example only, a sixty degree twist angle on the lobes of blower rotors may be employed, and it may correspond to the largest twist angle that a lobe hobbing cutter can accommodate. In examples of the present teachings, the twist angle may be predetermined and the helix angle for the lobe may then be determined, such as described in further detail subsequently. In some configurations, a Roots-type blower may include a greater twist angle (for example, as much as 120 degrees), which may result in a higher/greater helix angle and an improved performance, specifically, a higher thermal compressor efficiency, and lower input power.

In some configurations, air flow characteristics of a Roots-type blower and the speed at which the blower rotors can be rotated may be a function of the lobe geometry, including the helix angle of the lobes. It may be desirable for the linear velocity of the lobe mesh (e.g., the linear velocity of a point at which meshed rotor lobes move out of mesh) to approach the linear velocity of the air entering the rotor chambers through the inlet port. If the linear velocity of the lobe mesh (which may be referred to hereinafter as "V3") is much greater than the linear velocity of incoming air (which may be referred to hereinafter as "V1"), the movement of the lobe may, in effect, draw at least a partial vacuum on the inlet side. Such a mismatch of V1 and V3 may cause pulsations, turbulence, and/or noise, and creating such requires "work." Pulsations, turbulence, and/or noise may be may undesirable, such as for an engine supercharger that may rotate at speeds of as much as 15,000 to about 18,000 rpm or more.

It would be desirable to increase the "pressure ratio" of a blower (e.g., the ratio of the outlet pressure (absolute) to inlet pressure (absolute)). A higher pressure ratio may result in a greater horsepower boost for the engine with which the blower is associated. In some configurations, it may be desirable to prevent a Roots-type blower from exceeding a pressure ratio that results in an outlet air temperature in excess of 150 degrees Celsius.

SUMMARY

A Roots-type blower may includes a housing defining first and second transversely overlapping cylindrical chambers and first and second meshed, lobed rotors disposed, respectively, in said first and second chambers. The housing may include a first end wall defining an inlet port, and an outlet port formed at an intersection of the first and second chambers and adjacent to a second end wall. Each rotor may include a number of lobes, each lobe having first and second axially facing end surfaces sealingly cooperating with said first and second end walls, respectively, and a top land sealingly cooperating with said cylindrical chambers, said lobes defining a control volume between adjacent lobes on a rotor. In examples of the present teachings, the inlet port may be in at least partial communication with two control volumes on each of the first and second rotors.

In examples of the present teachings, the lobes may cooperate with an adjacent surface of the first and second chambers to define at least one internal backflow passage that occurs in a cyclic manner and moves linearly, as the lobe mesh moves linearly, in a direction toward the outlet port. The internal backflow passage may provide adjacent control volumes in communication. At a first rotor rotational speed, the internal backflow passage may provide fluid communication between adjacent control volumes such that there is no internal compression of the fluid within the blower and, at a second rotor rotational speed greater than the first rotor rotational speed, the internal backflow passage may provide fluid communication between adjacent control volumes such that there is internal compression of the fluid within the blower.

DETAILED DESCRIPTION

Figure 1:
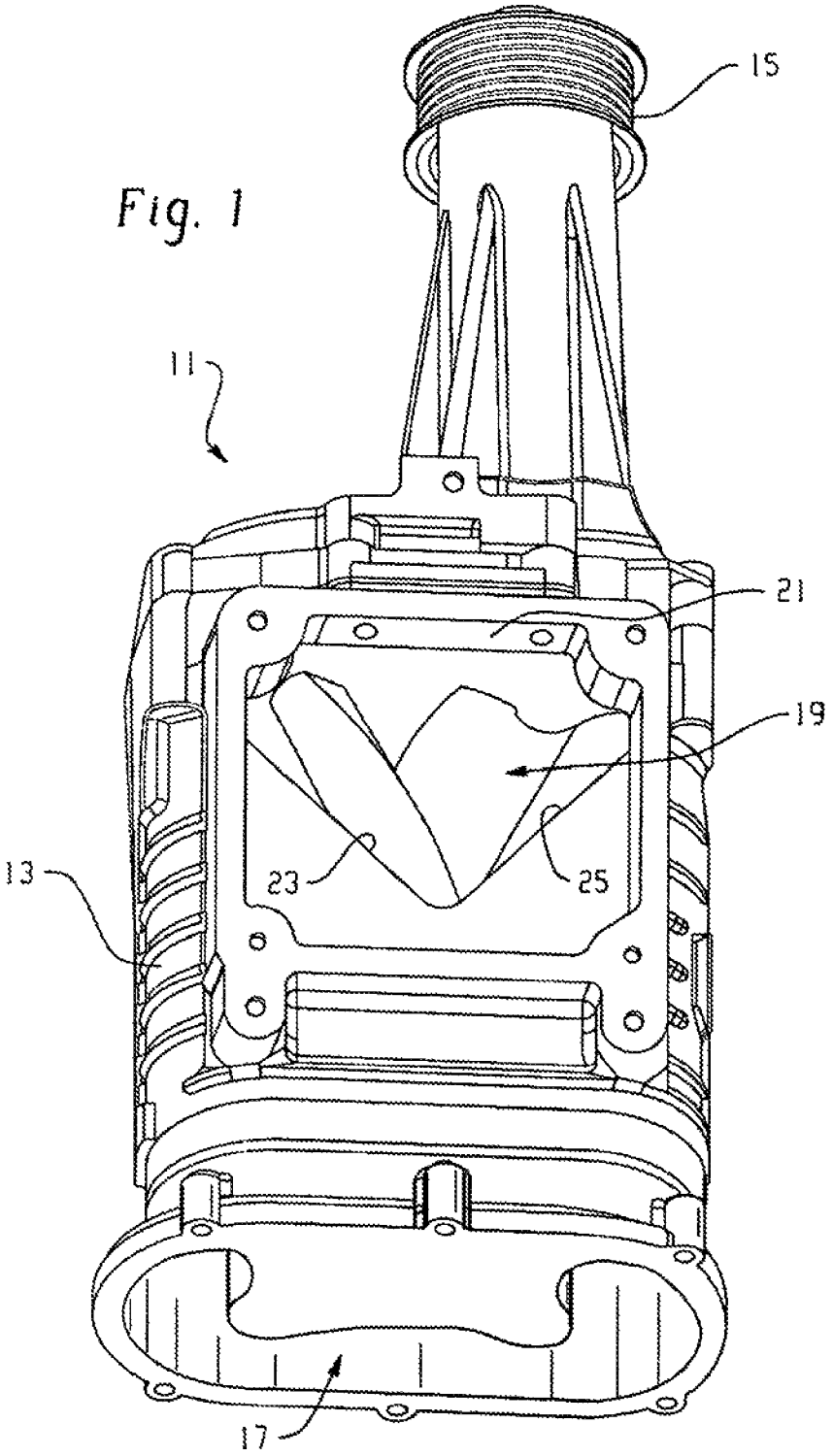
FIG. 1 is a perspective view of a Roots-type blower according to aspects of the present teachings, showing both the inlet port and the outlet port.

Referring now to the drawings, which are not intended to limit the examples of the present teachings, FIG. 1 is an external, perspective view of a Roots-type blower, generally designated 11, which includes a blower housing 13. Blower 11 may be of a rear/axial inlet, radial outlet type (e.g., inlet port 17 may be an axial inlet port and/or outlet 19 may be a radial outlet port) and/or mechanical input to drive the blower rotors may be via a pulley 15. Pulley 15 may be disposed toward a forward end of the engine compartment. Toward the "lower" end of the view in FIG. 1, the blower housing 13 may define an inlet port, generally designated 17.

Figure 1A:
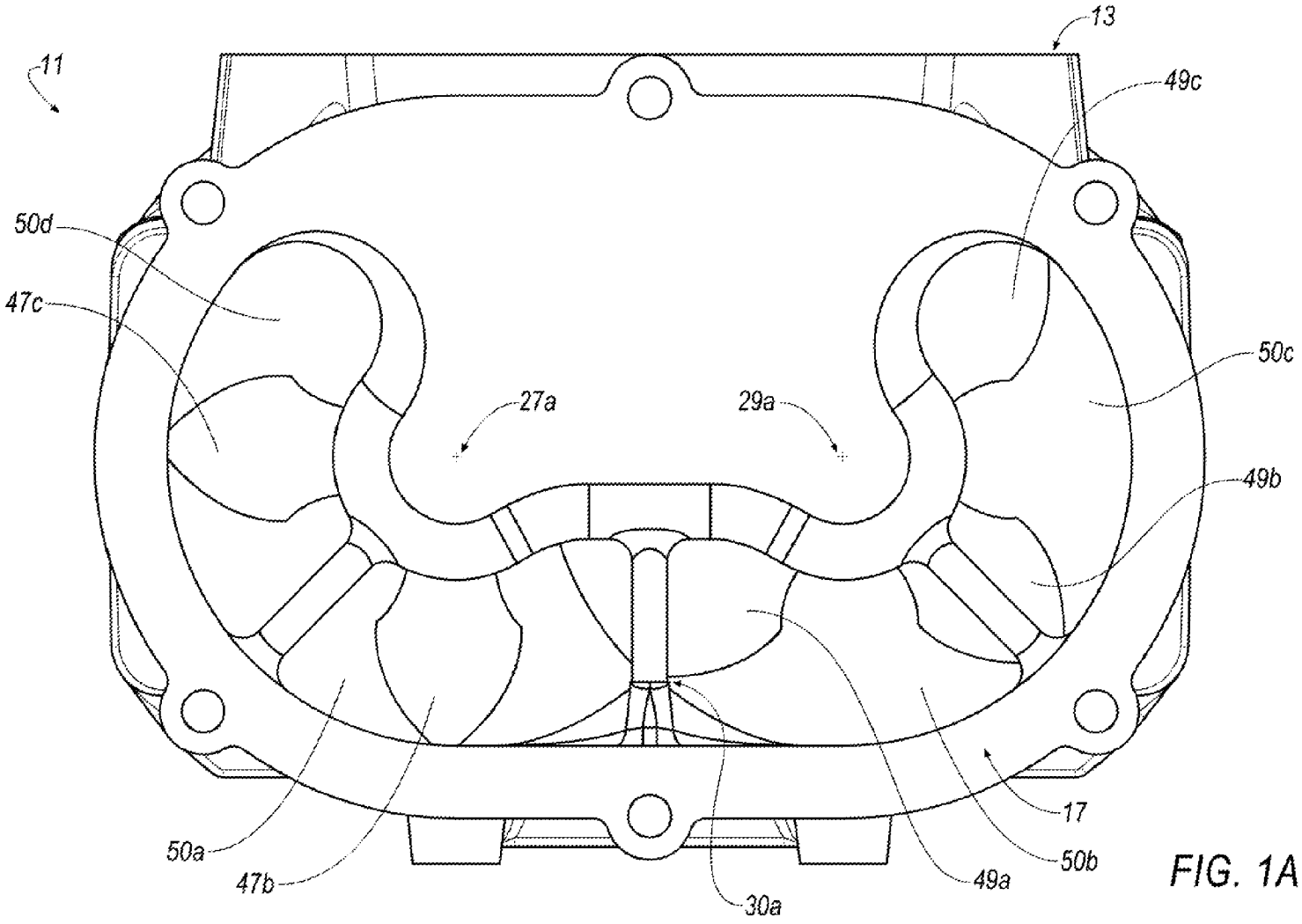
FIG. 1A is a side view of a Roots-type blower according to aspects of the present teachings.
Figure 1B:
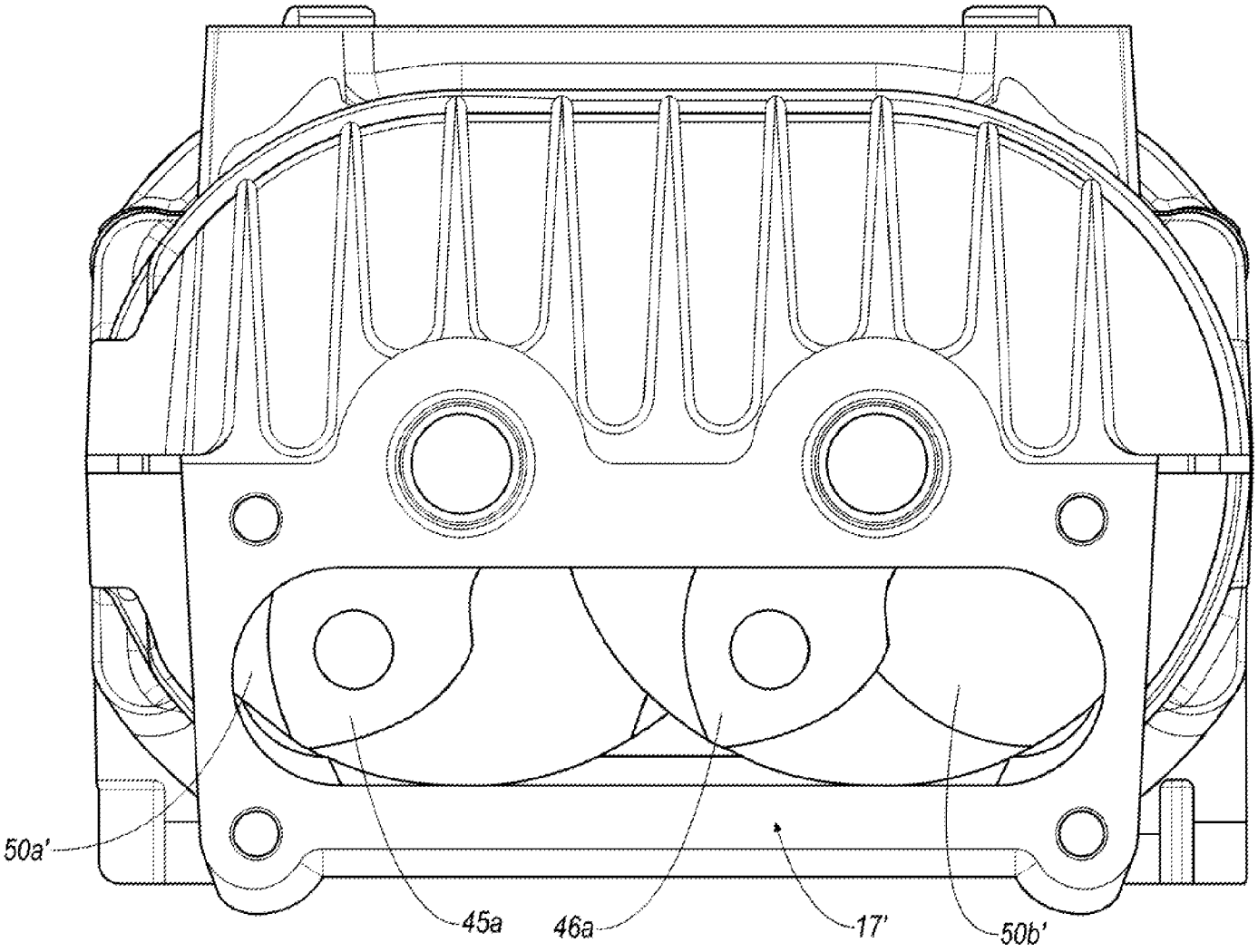
FIG. 1B is a side view of a Roots-type blower.

Blower housing 13 may define an outlet port, generally designated 19 which, as may best be seen in FIG. 1, may be generally triangular. Outlet port 19 may include an end surface 21, which may be generally perpendicular to an axis A (see, e.g., FIG. 2) of blower 11, and/or may include a pair of side surfaces 23 and 25. It will be appreciated that in light of the present disclosure that it may be desirable for inlet port 17 to be configured such that the inlet seal time may be at least equal to the amount of the rotor lobe twist angle. As generally illustrated in FIGS. 1 and 1A, a greater twist angle may correspond to a greater extent of inlet port 17 (e.g., in rotational degrees), relative to a conventional inlet port 17', such as generally illustrated in FIG. 1B. The outside of the inlet port may be constrained by (e.g., may not be greater than) the outside diameter of the rotor bores. The inlet seal time may be at least equal to the twist angle, which may insure that the transfer volume is fully out of mesh prior to closing off communication of this volume to the inlet port. As generally illustrated in FIG. 1B, conventional blowers may include a generally rectangular inlet portion 17'. As generally illustrated in FIG. 1A, inlet port 17 of blower 11 may include a greater extent, which may include one or more generally curved portions that may extend beyond chamber axis 27*a* and/or chamber axis 29*a*. Inlet port 17 may be in fluid communication with a plurality of control volumes.

Figure 2:
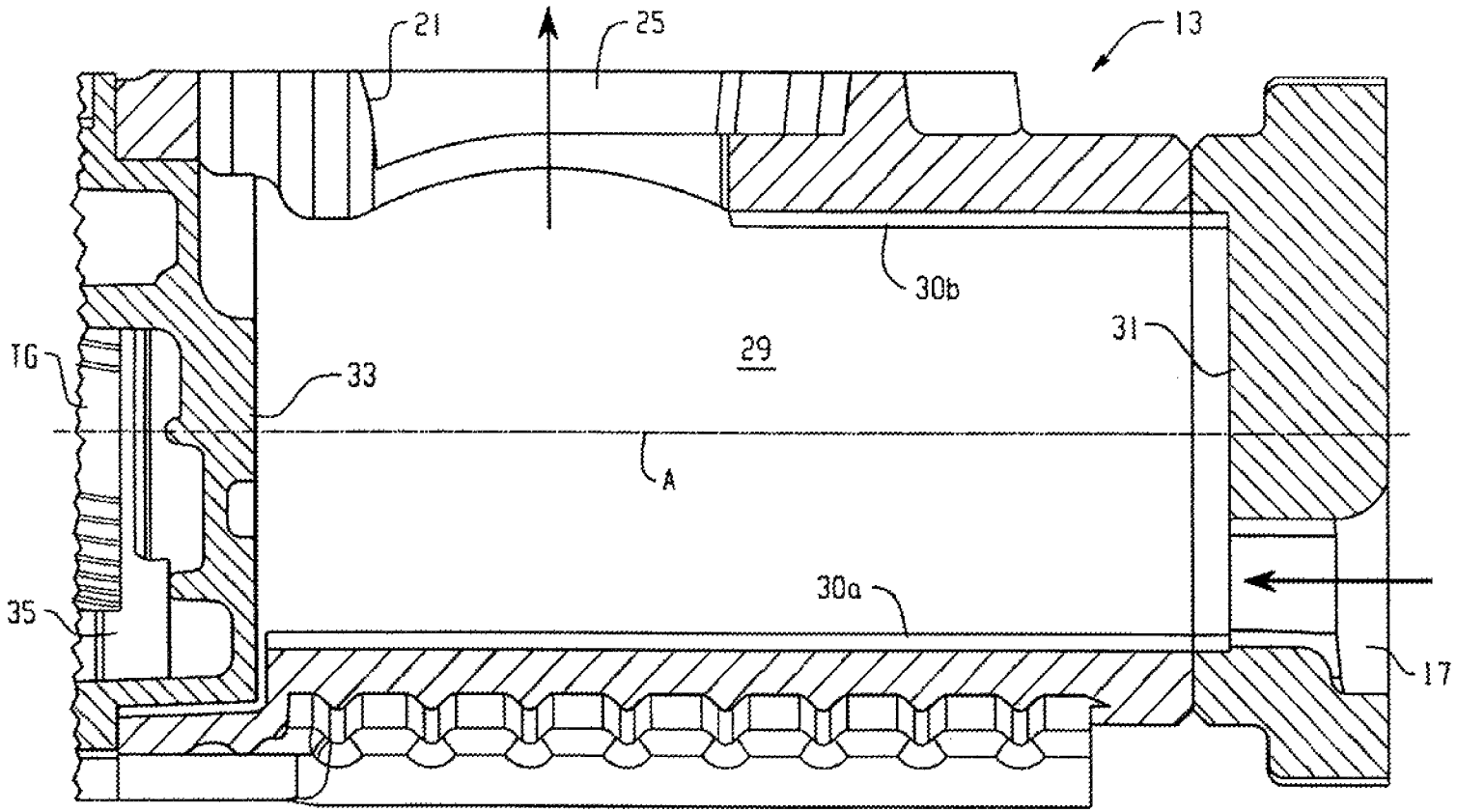
FIG. 2 is an axial cross-section of a housing of the Roots-type blower shown in perspective view in FIG. 1, but with the rotors removed for ease of illustration.
Figure 3:
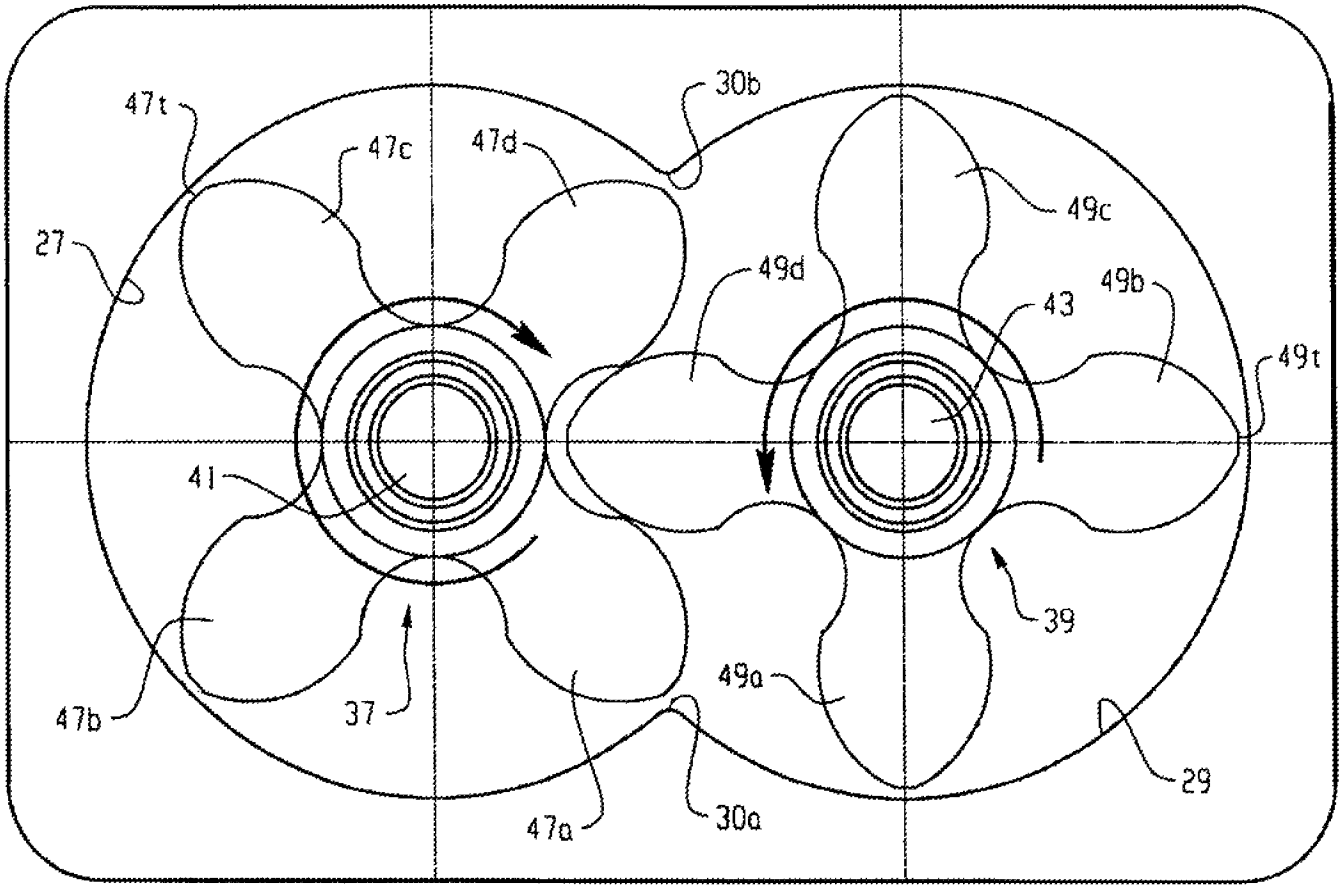
FIG. 3 is a diagrammatic view corresponding to a transverse cross-section through a blower in accordance with examples of the present disclosure, illustrating overlapping rotor chambers and rotor lobes.

Referring now to FIGS. 2 and 3, the blower housing 13 may define a pair of transversely overlapping cylindrical chambers 27 and 29, such that in FIG. 2, the view is from the chamber 27 into the chamber 29. In FIG. 3, the chamber 29 is generally designated as the right hand chamber, and FIG. 3 is a view taken from a rearward end (e.g., right end in FIG. 2) of the rotor chambers 27, 29 (e.g., looking forwardly in the engine compartment). The blower chambers 27 and 29 may overlap at an inlet cusp 30*a* (which may be in-line with the inlet port 17), and may overlap at an outlet cusp 30*b* (which may be in-line with, and actually may be interrupted by the outlet port 19).

Referring now primarily to FIG. 2, the blower housing 13 may define a first end wall 31 through which inlet port 17 may passes, and the first end wall 31 may be referenced herein as "defining" the inlet port 17. At the forward end of the chambers 27 and 29, the blower housing 13 may define a second end wall 33 that may separate the cylindrical rotor chambers 27 and 29 from a gear chamber 35. In various examples of the present teachings, gear chamber 35 may contain timing gears, one of which is shown partially broken away and designated TG.

Figure 4:
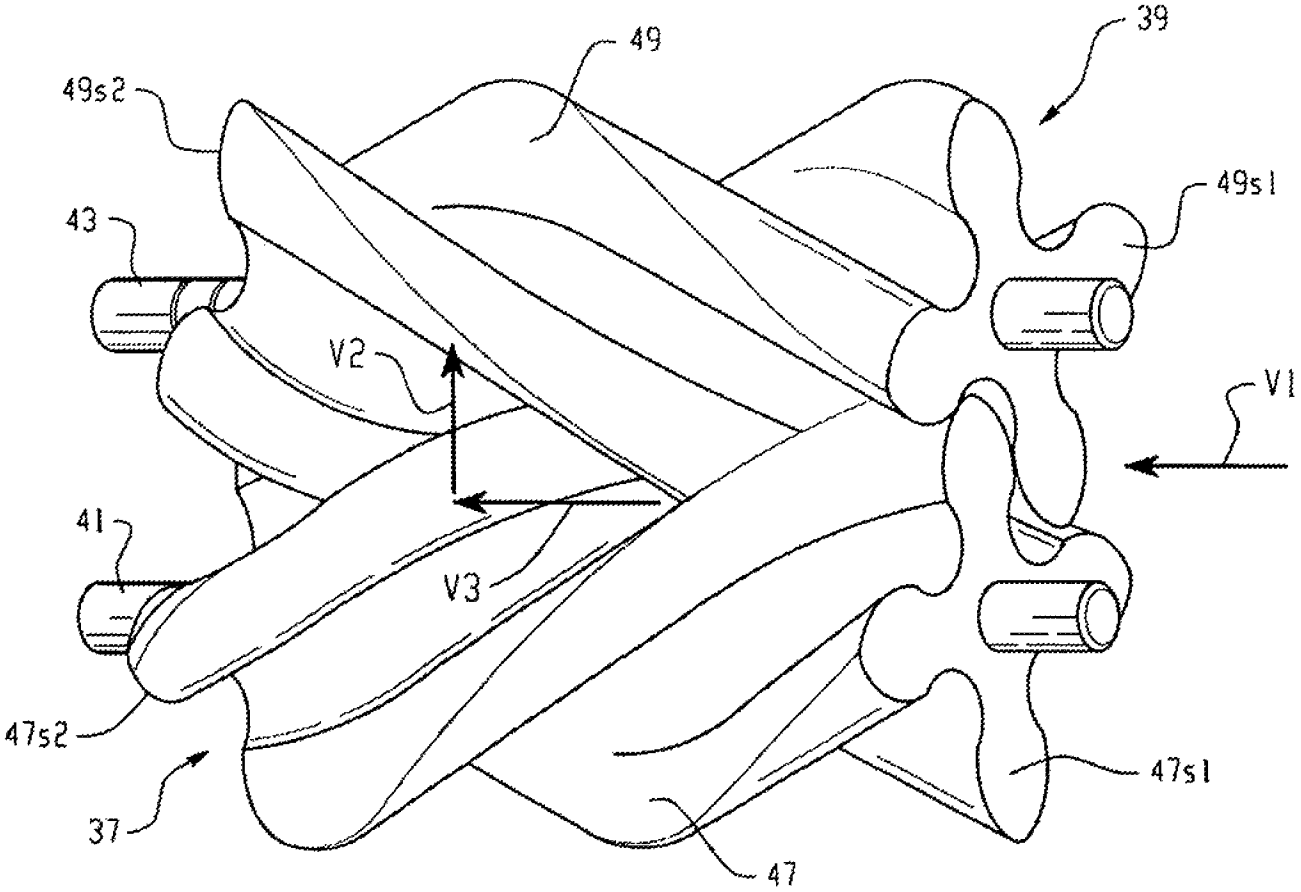
FIG. 4 is a top plan view of the rotor set shown diagrammatically in FIG. 3, and illustrating the helix angle of the lobes.

Referring now primarily to FIG. 3, but also to FIG. 4, a first rotor 37 may be disposed within the rotor chamber 27, and a rotor 39 may be disposed within the rotor chamber 29. The rotor 37 may be fixed relative to a rotor shaft 41 and the rotor 39 may be fixed relative to a rotor shaft 43. There may be a number of different methods known and available for forming blower rotors, and for thereafter fixedly mounting such rotors on their rotor shafts. For example, solid rotors may be used that may have lobes hobbed by a hobbing cutter and/or hollow rotors may be extruded, and the ends thereof may enclosed or sealed. The present disclosure may be utilized in connection with lobes of any type, no matter how formed, and in connection with any manner of mounting the rotors to the rotor shafts.

In various examples of the present teachings, each of the rotors 37 and 39 may have a plurality N of lobes. The rotor 37 may have lobes generally designated 47 and the rotor 39 may have lobes generally designated 49. In examples of the present teachings, the plurality N may be illustrated to be equal to 4, such that the rotor 37 may include lobes 47*a*, 47*b*, 47*c*, and 47*d*. In the same manner, the rotor 39 may include lobes 49*a*, 49*b*, 49*c*, and 49*d*. The lobes 47 have axially facing end surfaces 47*s*1 and 47*s*2, while the lobes 49 have axially facing end surfaces 49*s*1 and 49*s*2. It should be noted that in FIG. 4, the end surfaces 47*s*1 and 49*s*1 are actually visible, whereas for the end surfaces 47*s*2 and 49*s*2, the lead lines merely "lead to" the ends of the lobes because the end surfaces are not visible in FIG. 4. The end surfaces 47*s*1 and 49*s*1 sealingly cooperate with the first end wall 31, while the end surfaces 47*s*2 and 49*s*2 sealingly cooperate with the second end wall 33, in a manner well known to those skilled in the art, and which is not directly related to the present teachings.

When viewing the rotors from the inlet end as in FIG. 3, the left hand rotor 37 may rotate clockwise, while the right hand rotor 39 may rotate counterclockwise. Therefore, air which flows into the rotor chambers 27 and 29 through the inlet port 17 will flow into, for example, a control volume defined between the lobes 47*a* and 47*b*, or between the lobes 49*a* and 49*b*, and the air contained in those control volumes will be carried by their respective lobes, and in their respective directions around the chambers 27 and 29, respectively, until those particular control volumes are in communication with the outlet port 19. Each of the lobes 47 includes a top land 47*t*, and each of the lobes 49 includes a top land 49*t*, the top lands 47*t* and 49*t* sealingly cooperating with the cylindrical chambers 27 and 29, respectively, as is also well known in the art, and will not be described further herein.

In one aspect of the present teachings, a control volume may include the region or volume between two adjacent unmeshed lobes, after the trailing lobe has traversed the inlet cusp, and before the leading lobe has traversed the outlet cusp. However, it will be understood by those skilled in the art that the region between two adjacent lobes (e.g., lobes 47*d* and 47*a*) may also pass through the rotor mesh, such as lobe 49*d*, which is shown generally in mesh between the lobes 47*d* and 47*a* in FIG. 3. Each region, or control volume, may pass through the four phases of operation described in above (e.g., the inlet phase; the transfer phase; the backflow phase; and the outlet phase). As generally illustrated in FIG. 3, a control volume between the lobes 47*a* and 47*b* (and between lobes 49*a* and 49*b*) may comprise the inlet phase and/or the control volume between lobes 47*b* and 47*c* may comprise the inlet phase. The control volume between the lobes 47*c* and 47*d* is in the transfer phase, just prior to the backflow phase. If the lobe 47*d* passes the outlet cusp 30*b* in FIG. 3, the control volume between it and the lobe 47*c* may be exposed to the backflow phase. If the lobe 47*d* passes the outlet cusp 30*b*, at the plane of the inlet port (FIG. 3), the control volume may exposed to the outlet pressure through an internal backflow passage, to be described subsequently. To insure that there is not a leak back to the inlet port 17, the control volume between lobes 47*c* and 47*d* may be completely out of communication with the inlet port 17, (e.g., out of the inlet phase). If the lobe 47*d* is the leading lobe, and the lobe 47*c* is the trailing lobe of the control volume, the trailing lobe 47*c* must still be sealed to the chamber 27 at the peak of the inlet cusp 30*a*, when the leading lobe 47*d* is still sealed to the outlet cusp 30*b*, as shown in FIG. 3. The above configuration may correspond to a maximum amount of seal time for the inlet seal time and the transfer seal time, together, which may be significant in determining the maximum, ideal twist angle subsequently.

The performance of a Roots-type blower can be show to be improved by increasing the twist angle of the rotor lobes. Increasing the twist angle of rotor lobes may not, in and of itself, directly improve the performance of the blower. However, increasing the twist angle of the rotor lobes may permit an increase in the helix angle of each lobe. For each blower configuration, it is possible to determine a maximum ideal twist angle which may then be utilized to determine an optimum helix angle. A maximum ideal twist angle may include the largest possible twist angle for each rotor lobe without opening a leak path from the outlet port 19 back to the inlet port 17 through the lobe mesh.

Figure 5:
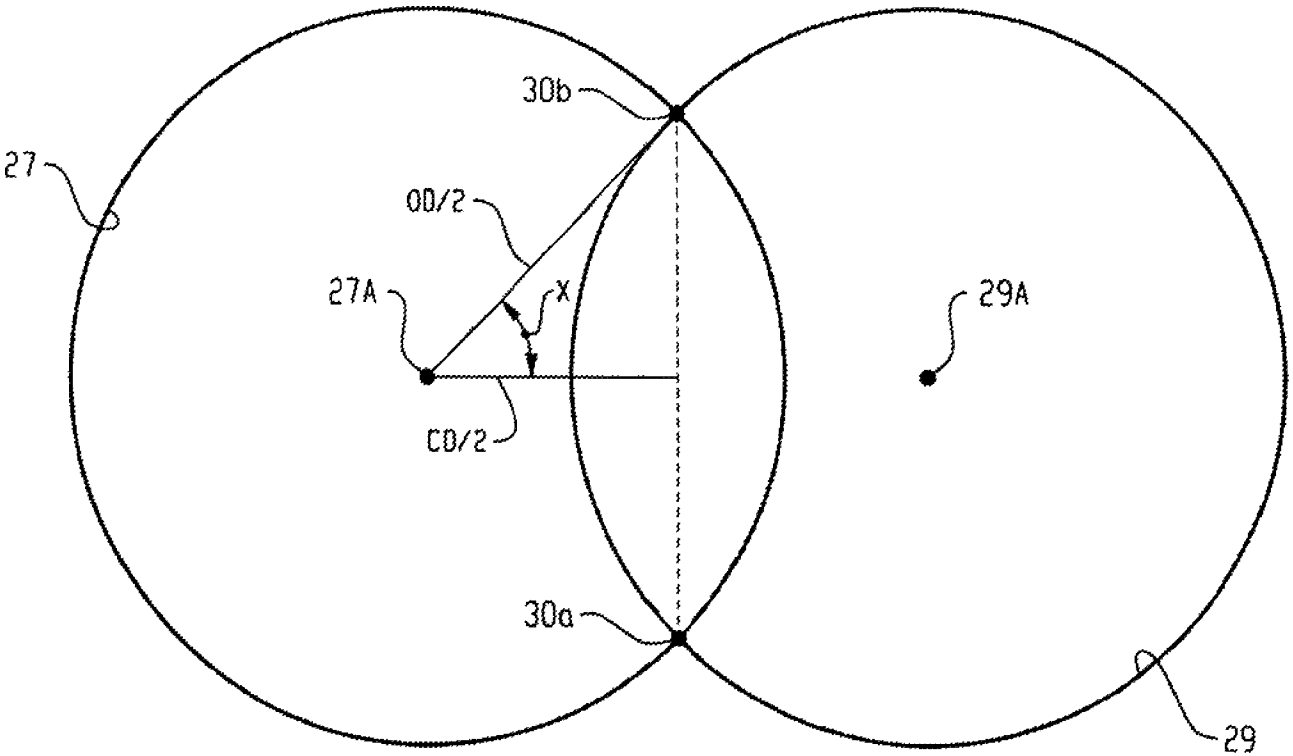
FIG. 5 is a geometric view representing rotor chambers in accordance with aspects of the present teachings, which may be used in determining the maximum ideal twist angle.

Referring now primarily to FIG. 5, there may be an "ideal" maximum twist angle, and that once the ideal maximum twist angle is determined, it can be used to determine a maximum (optimum) helix angle for the lobes 47 and 49. FIG. 5 illustrates a geometric view of the rotor chambers (overlapping cylindrical chambers) 27 and 29 which define chamber axes 27*a* and 29*a*, respectively. As may best be seen by comparing FIG. 5 to FIG. 3, the chamber axis 27*a* may be the axis of rotation of the rotor shaft 41, while the chamber axis 29*a* may be the axis of rotation of the rotor shaft 43. In various examples of the present teachings, such as generally illustrated in FIG. 5, a line CD/2 may represent one-half of the center-to-center distance between the chamber axes 27*a* and 29*a*.

The cylindrical chambers 27 and 29 may overlap along lines, such as at the inlet cusp 30*a* and the outlet cusp 30*b*. In various examples of the present teachings, such as generally illustrated in FIG. 5, dimension OD/2 may substantially equal one-half of the outside diameter defined by the rotor lobes 47 or 49. Determining the ideal maximum twist angle may include determining the rotational angle between the inlet cusp 30*a* and the outlet cusp 30*b*. As generally illustrated in FIG. 5, angle X may represent one-half of the angle between the inlet cusp 30*a* and the outlet cusp 30*b*. The angle X may be determined by the equation:

$$\text{Cosine } X = CD/OD; \text{ or stated another way,}$$

$$X = \text{Arc cos } CD/OD.$$

From the above, it has been determined that the maximum ideal twist angle ($TA_M$) may be determined as follows:

$$TA_M = 360 - (2 \text{ times } X) - (360/N); \text{ wherein}$$

2 times X=cusp-to-cusp separation

N=the number of lobes per rotor

360/N=lobe-to-lobe separation.

In various examples of the present teachings, the maximum ideal twist angle ($TA_M$) may be determined to be about 170 degrees. It should be understood that, utilizing the above relationship, a twist angle for the lobes 47 and 49 may be calculated that may result in a total maximum seal time for the inlet seal time and the transfer seal time, together, which may include the transfer seal time being equal to zero. Such an allocation of seal times between the inlet and transfer (e.g., transfer seal time=0) may lead to the ideal maximum twist angle, which may be desirable for relatively high speed performance of blower 11. It may be desirable for optimum performance to be at a relatively lower speed of blower 11, the inlet seal time may be reduced, and the transfer seal time may be increased, correspondingly, but the total of inlet and transfer time may remain constant. In other words, the portion/shapes of the rotors 37, 39 of blower 11 may be "tuned" for a particular application (e.g., a particular vehicle and/or engine). A method of designing a rotor for a Roots-type blower may include determining an "optimum" helix angle, at which the "transfer" seal time is zero. Then if improved low-speed efficiency is desired for a particular application, the transfer seal time may be increased, as described above, with the inlet seal time decreasing accordingly, and the maximum ideal twist angle ($TA_M$) also decreasing accordingly.

In accordance with the present teachings, a next step in the design method may include utilizing the maximum ideal twist angle $TA_M$ and the lobe length to calculate the helix angle (HA) for each of the lobes 47 or 49. By adjusting the lobe length, the optimal helix angle may be achieved. As was mentioned previously, the helix angle HA may be calculated at the pitch circle (or pitch diameter) of the rotors 37 and 39, as those terms are well understood to those skilled in the gear and rotor art. In various aspects of the present teachings, the maximum ideal twist angle $TA_M$ may be calculated to be approximately 170 degrees, the helix angle HA may be calculated as follows:

$$\text{Helix Angle } (HA) = (180/\pi * \arctan(PD/\text{Lead}))$$

wherein: PD=pitch diameter of the rotor lobes; and

Lead=the lobe length required for the lobe to complete 360 degrees of twist, the Lead being a function of the twist angle ($TA_M$) and the length of the lobe.

In other examples of the present teachings, the helix angle HA may be calculated to be about 29 degrees. In further examples, the helix angle HA may be calculate to be less than, greater than, and/or at least 29 degrees.

In various examples of the present teachings, it may be possible to increase the size and flow area of the inlet port 17. As may be appreciated by viewing FIG. 1, in conjunction with FIG. 3, the inlet port 17 may include a greater arcuate or rotational extent (e.g., greater than conventional), on each side of the inlet cusp 30*a*, which may increase the period of time during which incoming air is flowing through the inlet port 17 into the control volumes between adjacent lobes. Conventional inlet ports, such as conventional inlet port 17', may only be in fluid communication with two control volumes at any one time. For example, conventional inlet port 17', such as generally illustrated in FIG. 1B, may permit air to flow into control volume 50*a'* to the left of the lobe 45*a* (e.g., between lobe 45*a* and lobe 45*b*, which is hidden in FIG. 1B), and may provide at least partial filling of a control volume 50*b'* to the right of lobe 46*a* (e.g., between lobe 46*a* and lobe 46*b*, which is hidden in FIG. 1B). In contrast, as may be seen by comparing FIGS. 1, 1A, and 3, the inlet port 17 of the present teachings may be in fluid communication with more than two control volumes in at least one rotational position of rotors 37, 39. For example, and without limitation, inlet port 17 may be in fluid communication with four control volumes, which may include a control volume 50*a* that may be between lobe 47*b* and 47*c*, a control volume 50*b* that may be between 49*a* and 49*b*, a control volume 50*c* that may be between lobes 49*b* and 49*c*, and/or a control volume 50*d* that may be between lobes 47*c* and 47*d* (lobe 47*d* is hidden in FIG. 1A).

In examples of the present teachings of blower 11, rotors 37, 39 may include greatly increased helix angles (HA) of their respective lobes 47 and 49. In further aspects of the present teachings, it may be desirable to avoid and/or minimize a "mismatch" between the linear velocities of air entering the rotor chambers through the inlet port 17 and the linear velocity of the lobe mesh. In FIG. 4, there are arrows labeled to identify various quantities:

V1=linear velocity of inlet air flowing through the inlet port 17;

V2=linear velocity of the rotor lobe in the radial direction; and

V3=linear velocity of the lobe mesh.

In various examples of the present teachings, V1 may be equal to the rotational speed of blower (RPM) multiplied by the displacement of blower 11, all divided by the area of inlet 17. Moreover, V2 may be equal to the rotational speed of blower (RPM) multiplied by the radius of rotor 37 and/or rotor 39. V3 may equal V2 divided by the tangent of the helix angle of rotor 37 and/or rotor 39.

Figure 6:
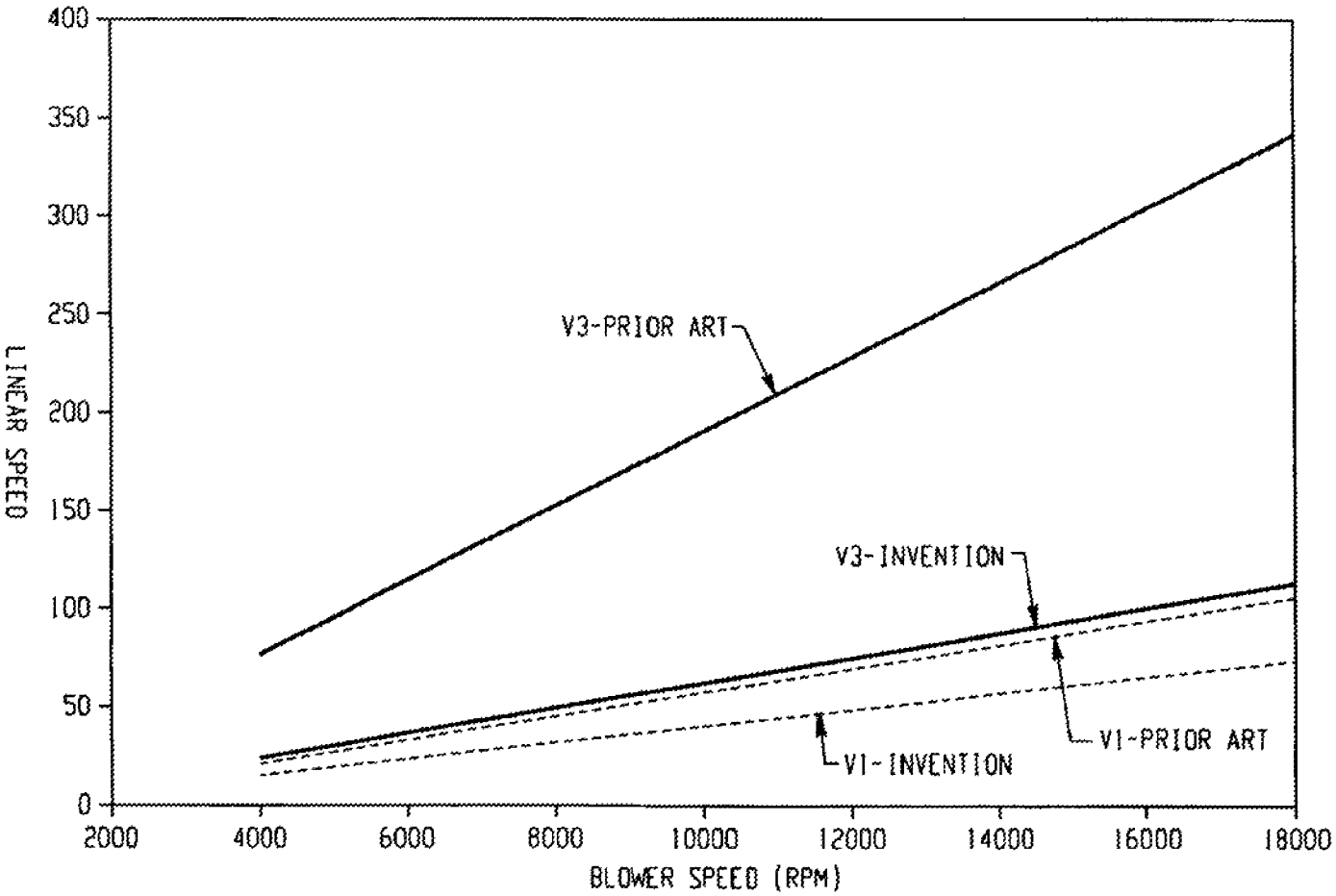
FIG. 6 is a graph of linear speed, in meters/second, showing both lobe mesh and inlet air speed, as a function of blower rotor speed of rotation (in RPM), comparing examples of the present disclosure to conventional configurations.

Referring still to FIG. 4, but now in conjunction with the graph of FIG. 6, it may be seen that with conventional Roots-type blowers (the data generally identified as "Prior Art" in the Figure), which have the comparatively much smaller helix angles, there can be a substantial mismatch between V1 and V3. The mismatch can be sufficiently large such that, in "Prior Art" devices, the linear speed V3 of the lobe mesh travels several times faster than the flow of inlet air V1, which may create a substantial amount of undesirable turbulence and/or a vacuum. Previously, it has been observed that, at approximately 8,500 rpm, the "generated noise" would exceed 100 db.

In various examples of the present teachings, it may be seen in FIG. 6 that the gap between V1 and V3 may be much smaller, which may allow for much less turbulence and much less likelihood of drawing a vacuum. Examples of the present disclosure have been tested and generated noise does not exceed 100 db, even as the blower speed has increased to greater than 16,000 rpm. In further examples of the present teachings, such as generally illustrated via FIG. 6, for certain rotor lobe configurations (e.g., helix angles), V1 may "lag" V3, but as the helix angle HA increases, the linear velocity V3 of the lobe mesh decreases, which may decrease the gap between V3 and V1. A decreased gap between V3 and V1 may permit less air turbulence (pulsation), less vacuum being drawn, and/or less noise being generated.

Figure 7:
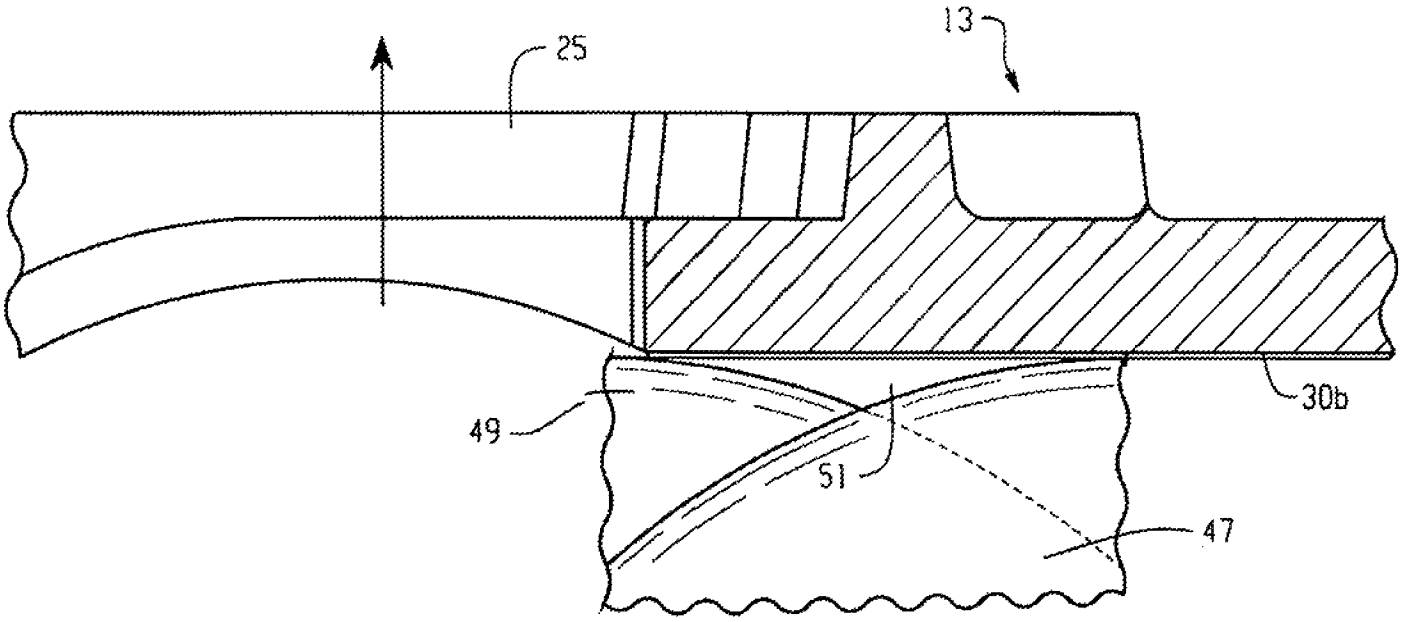
FIG. 7 is an enlarged, fragmentary, axial cross-section view showing a portion of the lobe mesh according to examples of the present disclosure.
Figure 7A:
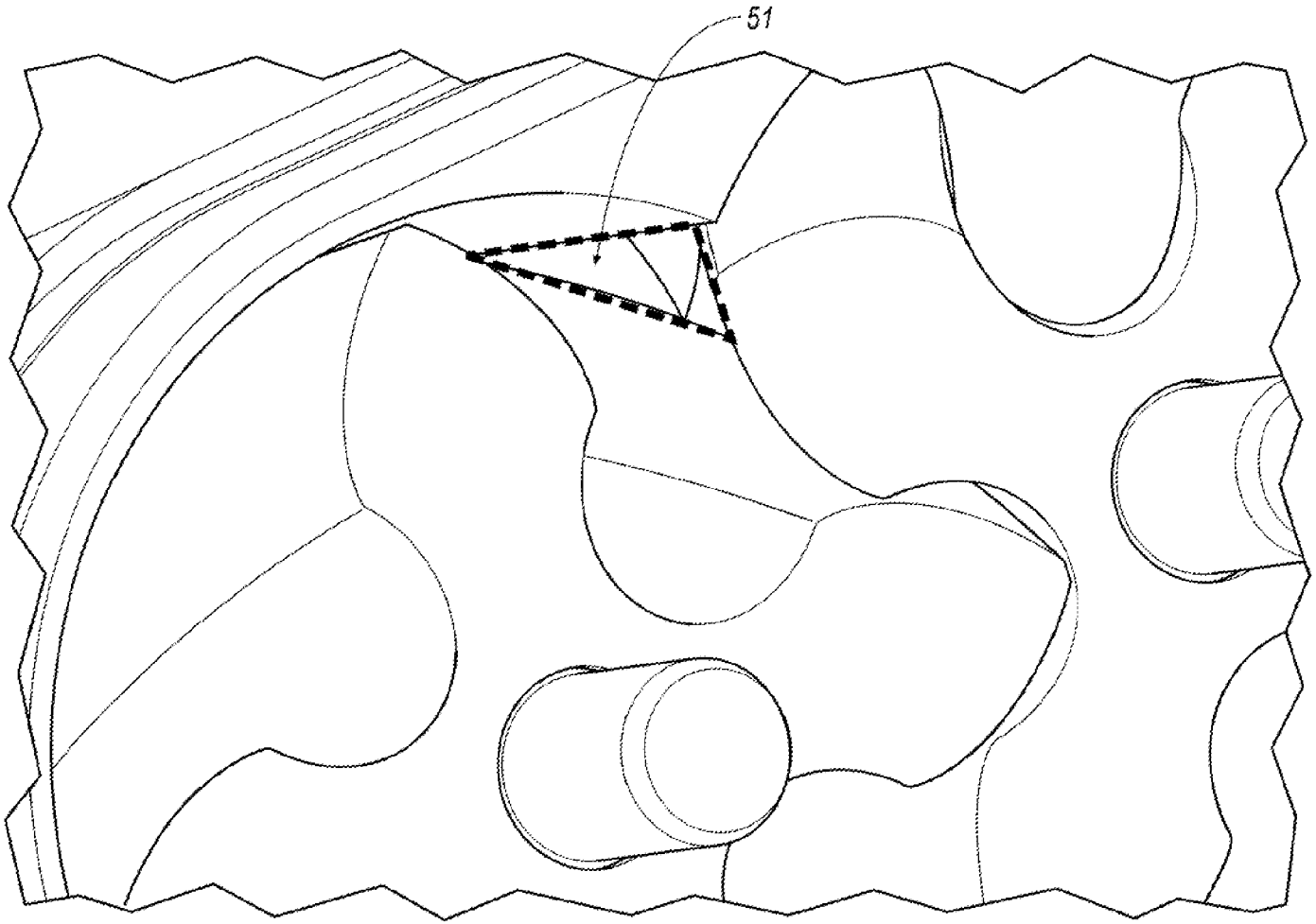
FIG. 7A is an enlarged, partial cross-sectional view showing portions of examples of a Roots-type blower in accordance with teachings of the present disclosure.

Referring now primarily to FIG. 7, a potential advantage of a substantially increased helix angle HA will be described. As the rotors 37 and 39 rotate, the lobes of rotors 37 and 39 (e.g., 47*a*, etc., 49*a*, etc.) may move into and out of mesh and, instantaneously, may cooperate with the adjacent surface of the rotor chambers 27 and 29, along the outlet cusp 30*b*, to define a blowhole, generally designated 51. A blowhole 50 may also be referred to as a backflow port 51 or as an internal backflow passage 51. As each internal backflow passage 51 is generated by the meshing of the lobes, an internal backflow passage 51 may internally (e.g., within housing 13) provide fluid communication between a first control volume and its preceding control volume. This has been referenced previously as the backflow phase or "event" and this backflow event may allow the first control volume to equalize in pressure prior to opening to the outlet port 19.

In examples of the present teachings, formation of a blow hole 51 may occur in a cyclic manner, which may include one internal backflow passage 51 being formed by two adjacent, meshing lobes 47 and 49, the internal backflow passage may move linearly as the lobe mesh moves linearly, in a direction toward the outlet port 19. The internal backflow passage 51 may be present until it linearly reaches the outlet port 19. There can be several internal backflow passages 51 generated and present at any one time, depending on the extent of the backflow seal time. A backflow event involving a plurality of internal backflow passages 51 may be desirable as it may create a continuous event that is distributed over several control volumes, which has the potential to even out the transition to the outlet event or phase over a longer time period, which may improve the efficiency of the backflow event.

It will be appreciated in light of the present disclosure that an advantage of the formation of the internal backflow passage 51, which may result from the greater helix angle HA, is that backflow slots on either side of the outlet port 19 (e.g., typically, one parallel to each side surface 23 or 25) may not be included. In some examples of the present teachings, as may best be seen in FIG. 1, there may be no provision in the blower housing 13, adjacent the outlet port 19 for such backflow slots.

It will be appreciated in light of the present disclosure that another advantage of the greater helix angle may include that the blower 11 may be able to operate at a higher pressure ratio, which may include a ratio of the outlet pressure (in psia) to inlet pressure (also in psia). By way of contrast, previous Roots blower superchargers would reach an operating temperature of 150 degrees Celsius (outlet port 19 air temperature) at a pressure ratio of about 2.0. The blower 11 has been found to be capable of operating at a pressure ratio of about 2.4 before reaching the determined "limit" of 150° Celsius outlet air temperature. This greater pressure ratio represents a much greater potential capability to increase the power output of the engine.

In general, a performance difference between screw compressor type superchargers and conventional Roots blower superchargers may include that convention Roots-type blowers (e.g., with smaller helix angles) do not generate any internal compression (e.g., does not actually compress the air within the blower, but merely transfers the air). In contrast, the typical screw compressor supercharger does internally compress the air. However, example of the present teachings of Roots-type blower 11 may generate a certain amount of internal compression. At relatively low speeds, when typically less boost is required, the internal backflow passage 51 (or more accurately, the series of internal backflow passages 51) serves as a "leak path" such that there is no internal compression. If the blower speed increases (for example, as the blower rotors are rotating at 10,000 rpm and then 12,000 rpm etc.) and a correspondingly greater amount of air is being moved, the internal backflow passages 51 may still relieve some of the built-up air pressure, but as the speed increases, the internal backflow passages 51 may not be able to relieve enough of the air pressure to prevent the occurrence of internal compression, such that above some particular input speed (blower speed), just as there is a need for more boost to the engine, the internal compression gradually increases. In various examples of the present teachings, certain parameters of blower 11 can be configured to tailor the relationship of internal compression versus blower speed, for example, to suit a particular vehicle engine application.

Figure 8:
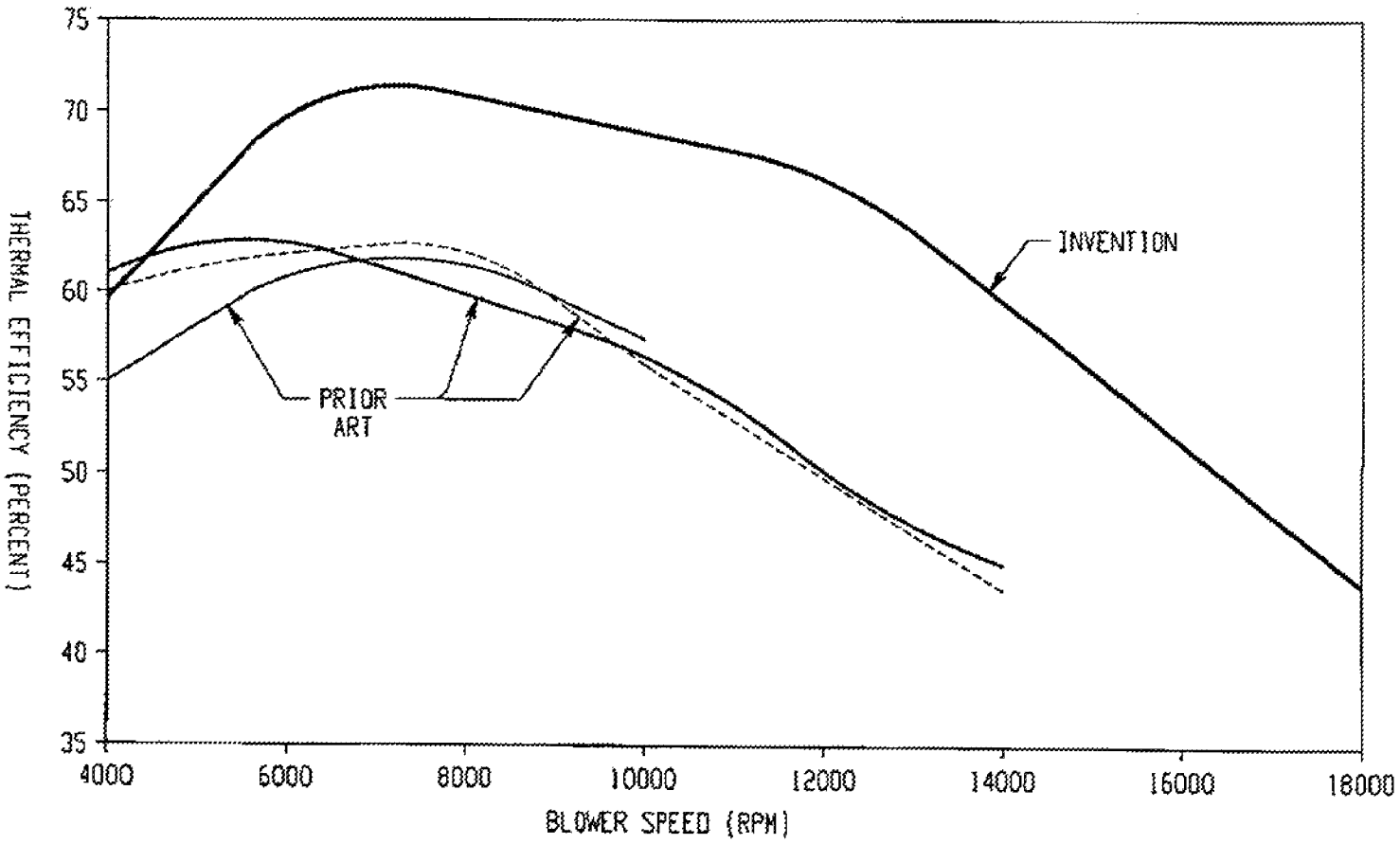
FIG. 8 is a graph of thermal efficiency, as a percent, versus blower rotor speed of rotation (in RPM), comparing examples of the present disclosure to conventional configurations.
Figure 9:
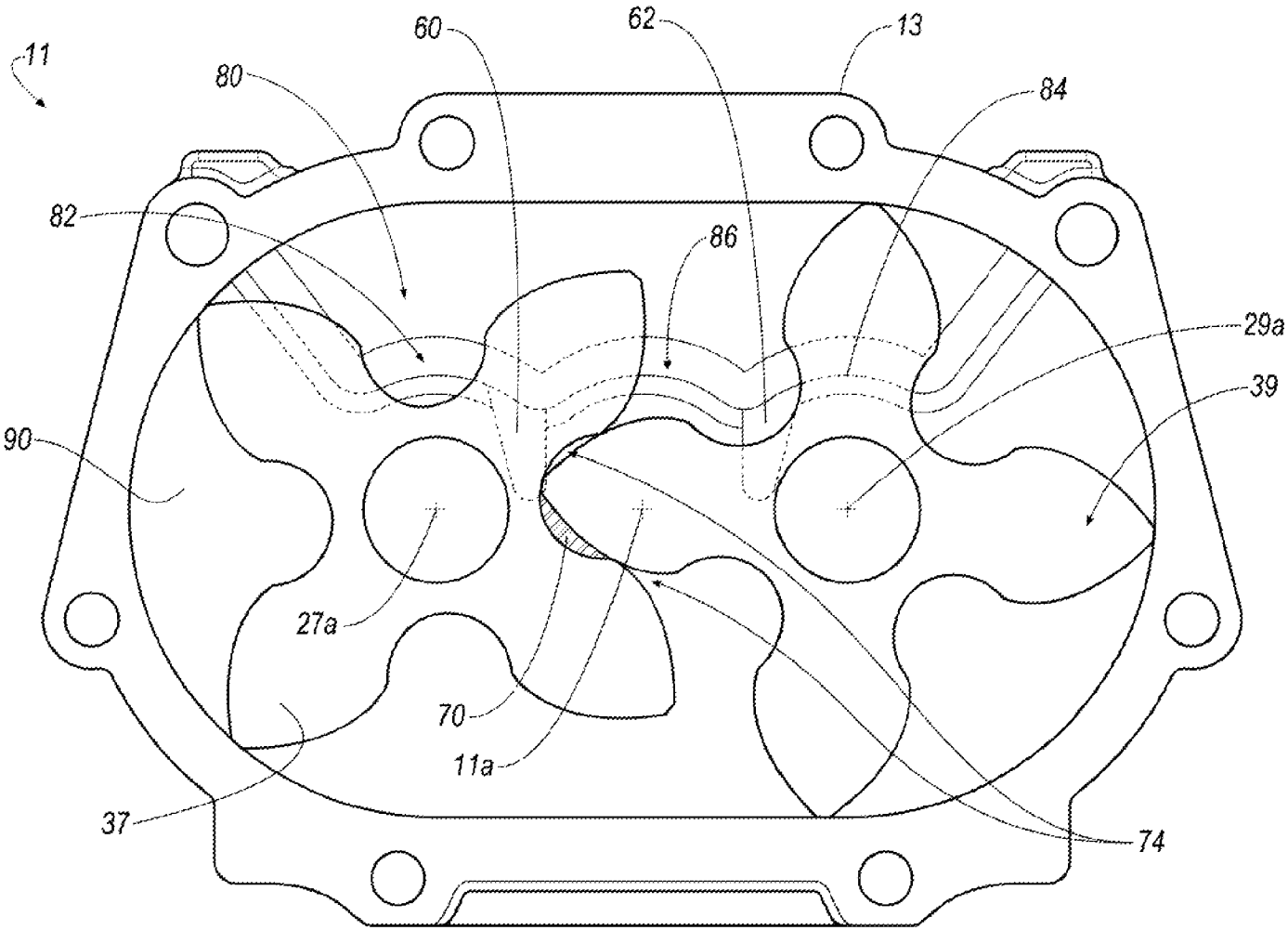
FIG. 9 is a partial cross-sectional view showing portions of examples of a Roots-type blower in accordance with teachings of the present disclosure.
Figure 10:
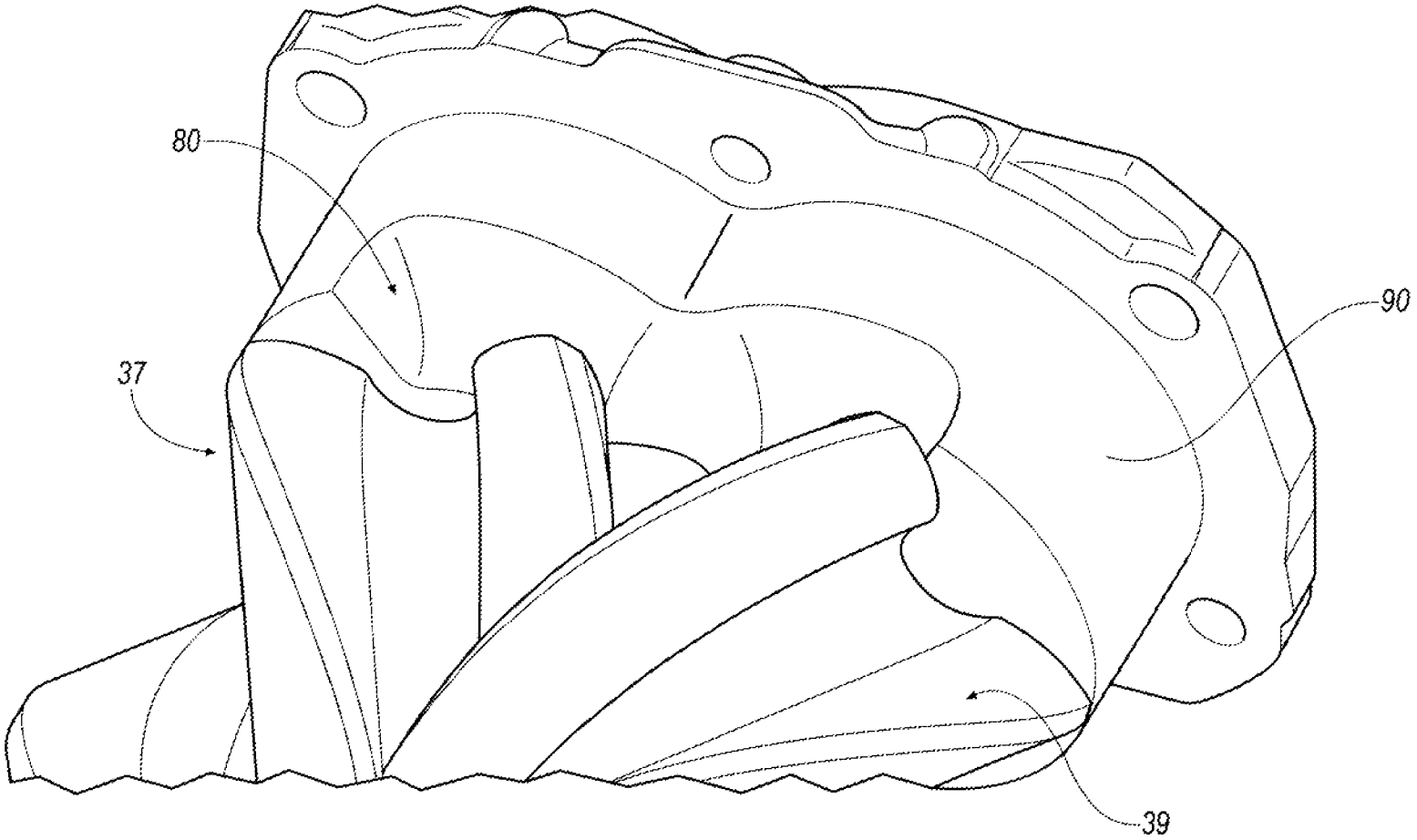
FIG. 10-12D are partial cross-sectional perspective views showing portions of aspects of the present teachings of Roots-type blowers in accordance with teachings of the present disclosure.
Figure 11:
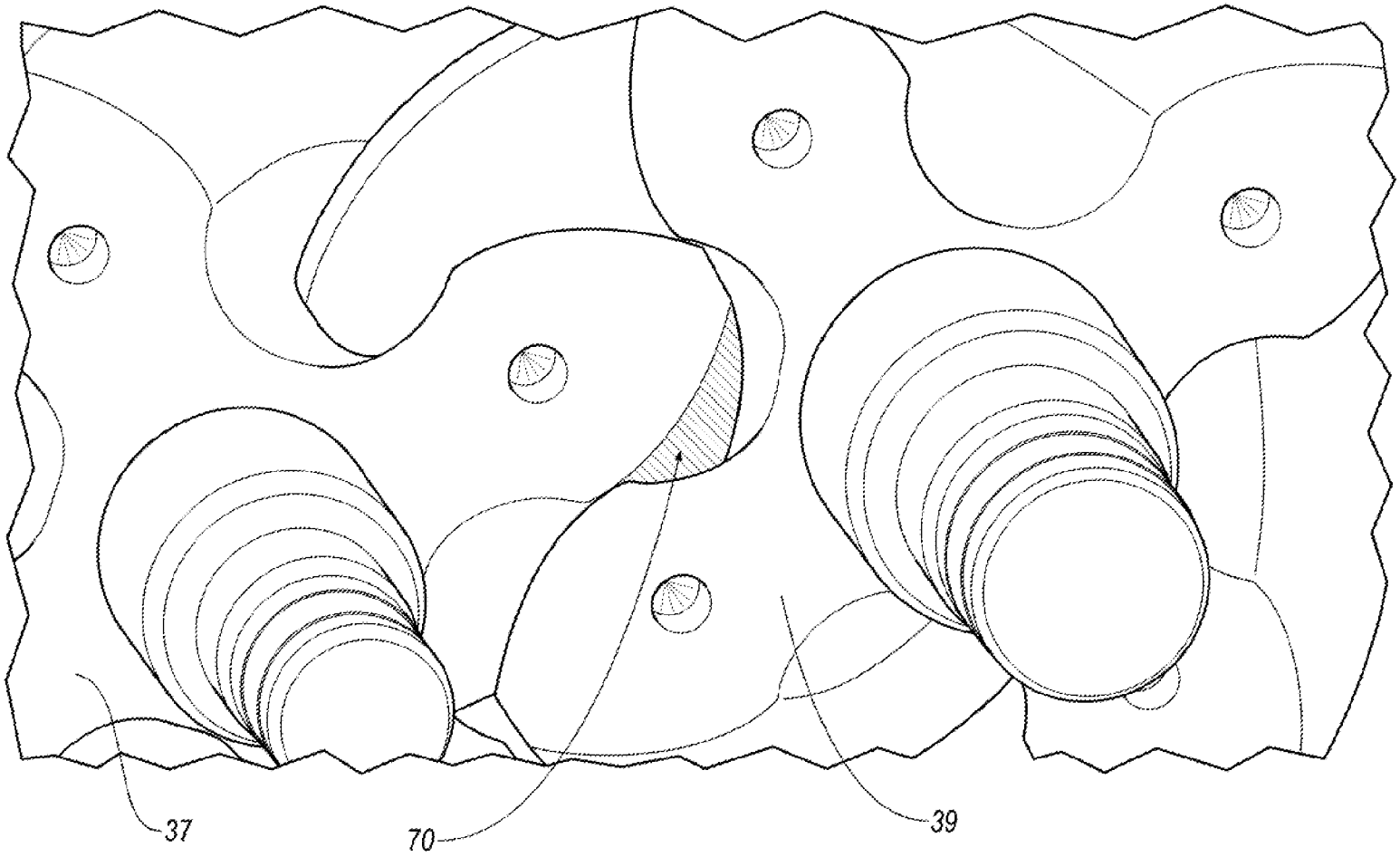

Referring now primarily to FIG. 8, there is provided a graph of thermal efficiency as a function of blower speed in RPM. It may be seen in FIG. 8 that there are three graphs representative of Prior Art devices, with two prior art Roots-type blowers being represented by the graphs which terminate at 14,000 rpm. The third Prior Art device may correspond to a screw compressor, for which the graph in FIG. 6 representing that device terminates at 10,000 RPM, it being understood in light of the present disclosure that the screw compressor could have been driven at a higher speed, but that the test was stopped. As used herein, terminate may refer to (e.g., in reference to the Prior Art graphs in FIG. 8) the unit reaching the determined limit of 150 degrees Celsius outlet air temperature, discussed previously. If that air temperature is reached, the blower speed may not be increased any further and the test may be stopped.

In contrast, it may be seen in FIG. 8 that a Roots-type blower made in accordance with examples of the present teachings (such as the example labeled "INVENTION") may achieve a higher thermal efficiency than any of the Prior Art devices, for example at about 4,500 rpm blower speed. In examples of the present teachings, the thermal efficiency of blower 11 may remain substantially above that of the Prior Art devices for all subsequent blower speeds. Moreover, the limit of 150° Celsius outlet air temperature may not occur until the blower 11 reached speeds in excess of 18,000 rpm.

Although the present teachings have been illustrated and described in connection with a Roots-type blower in which each of the rotors 37 and 39 has an involute, four lobe (N=4) design, it should be understood that the present teachings are not so limited. The involute rotor profile has been used in connection with the aspects set forth in this disclosure by way of example, and the benefits of the present teachings are not limited to any particular rotor profile. For example, and without limitation, some examples of the present teachings of Roots-type blower 11 may include 3, 4, or 5 lobes, such as if the blower is to be used as an automotive engine supercharger.

In examples of the present teachings, the number of lobes per rotor (N) may be less than 3 or greater than 5. Moreover, the maximum ideal twist angle ($TA_M$) may change for different numbers (N) of lobes per rotor. In referring back to the equation:

$$TA_M = 360 - (2 \text{ times } X) - (360/N)$$

and assuming that CD and OD remain constant as the number of lobes N is varied, it may be seen in the equation that the first part (360) and the second part (2 times X) may not be affected by the variation in the number of lobes, but instead, only the third part, (360/N) may change.

In examples of the present teachings, as the number of lobes N changes from 3 to 4 to 5, the change in the maximum ideal twist angle $TA_M$ (and assuming the same CD and OD as used previously) may, for example, vary as follows:

$$\text{for } N=3, TA_M = 360 - (2 \text{ times } 50) - (360/3) = 140°;$$

$$\text{for } N=4, TA_M = 360 - (2 \text{ times } 50) - (360/4) = 170°; \text{ and}$$

$$\text{for } N=5, TA_M = 360 - (2 \text{ times } 50) - (360/5) = 188°$$

Moreover, once the maximum ideal twist angle $TA_M$ is determined/calculated, the helix angle HA may be calculated knowing the length, based upon the diameter (PD) at the pitch circle, and the Lead.

In various examples of the present teachings, blower 11 may include one or more pressure reducing features, such as relief port 60 and/or relief port 62. Relief ports 60, 62 may be configured to reduce noise generated by blower 11 and/or reduce power consumed by operate blower 11.

In various examples of the present teachings, pressure relief ports 60, 62 may disposed partially and/or entirely inside of housing 13 and/or may be referred to as internal pressure relief ports 60, 62. The internal pressure relief ports 60, 62 may not be in direct fluid communication with ambient air, but may be in indirect fluid communication via outlet port 19 and/or outlet portion 80. As generally illustrated in FIGS. 9, 11, and 13A-14C, as rotors 37, 39 of blower 11 rotate; a high pressure area and/or a trapping area 70 may develop between lobes of meshing rotors 37, 39. Trapping area 70 may comprise a volume of fluid and/or may develop cyclically. Trapping area 70 may be generally located opposite the inlet 17 and/or located generally between chamber axes 27*a* and 29*a*.

Figure 12A:
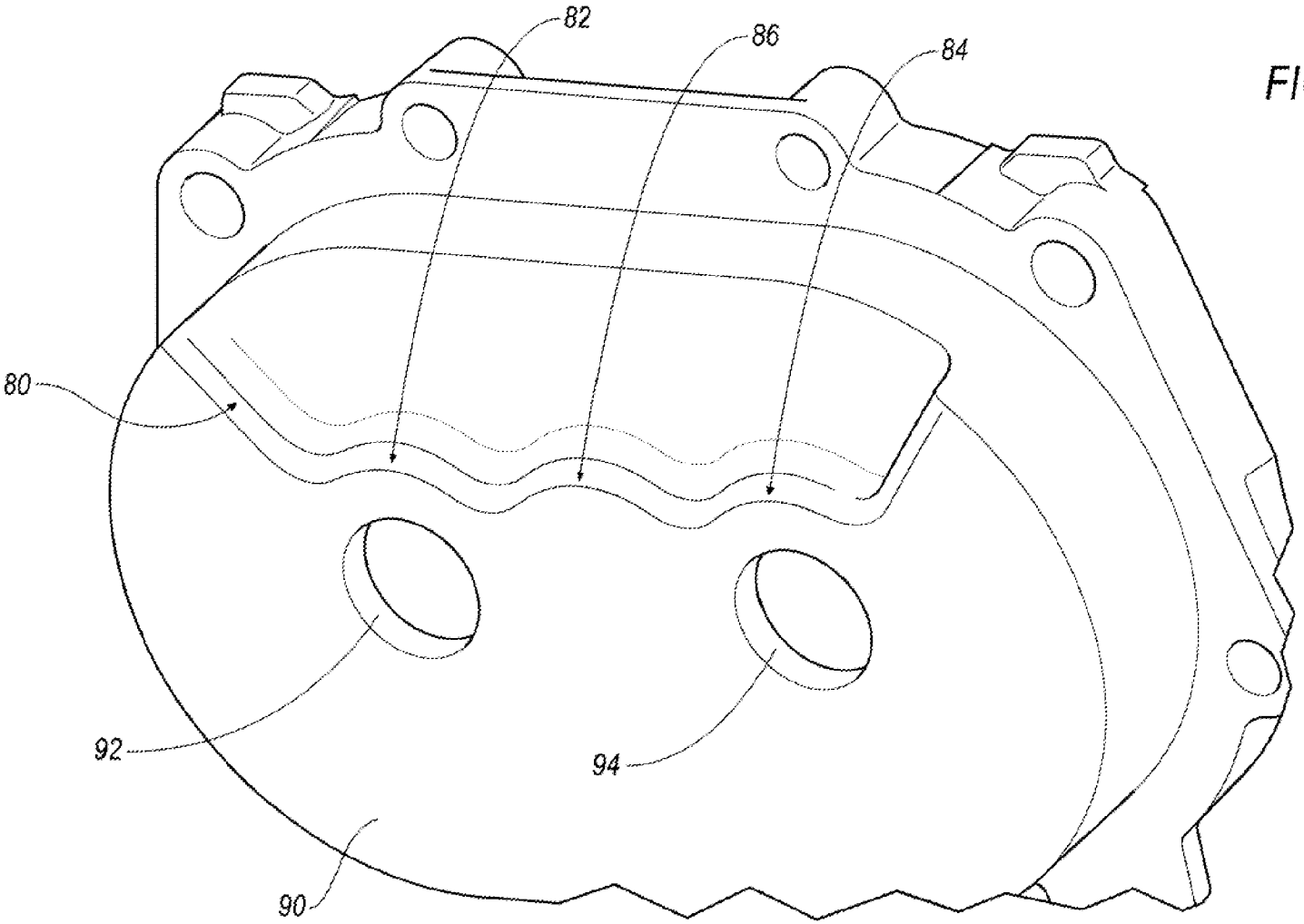
Figure 12B:
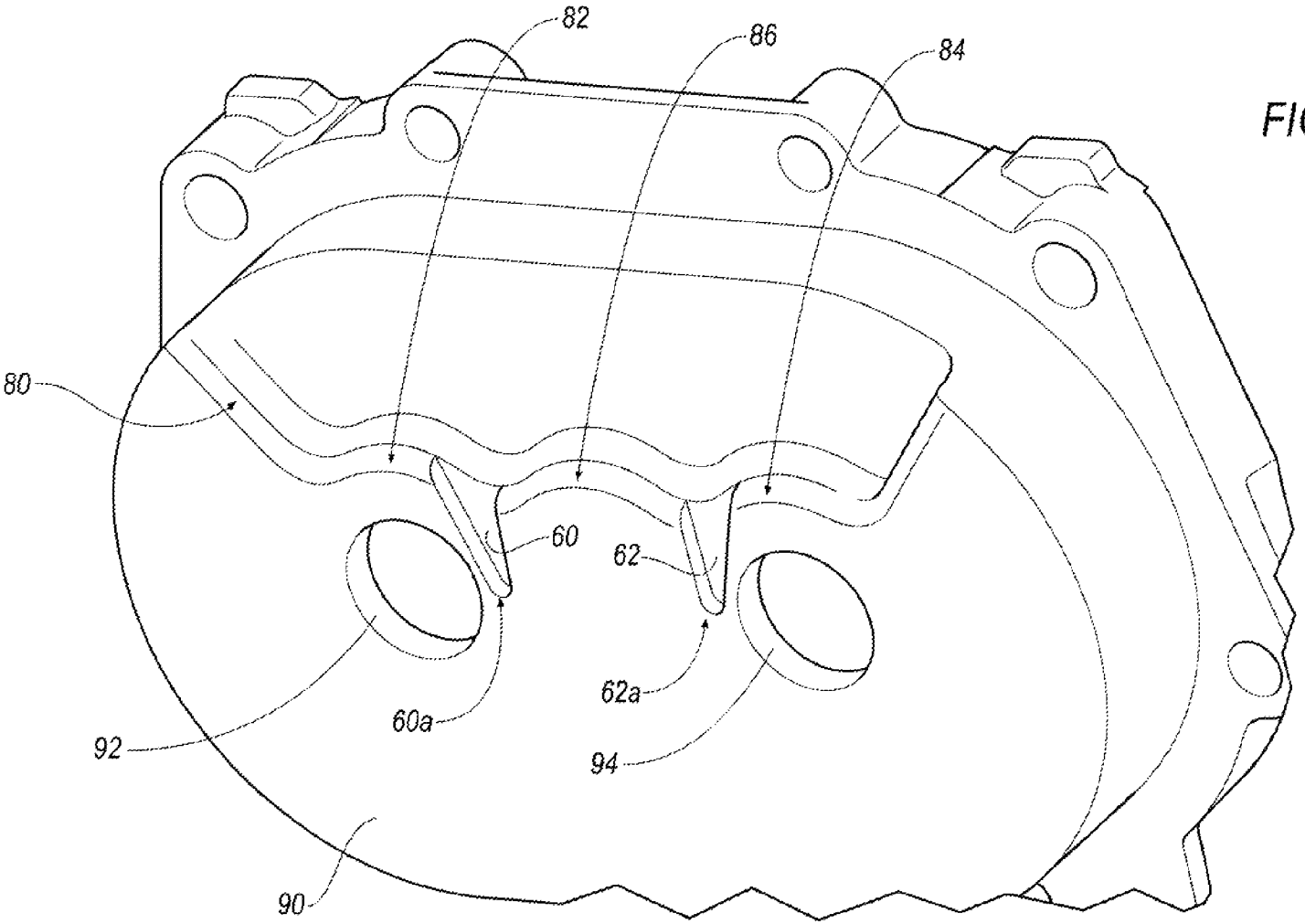
Figure 12C:
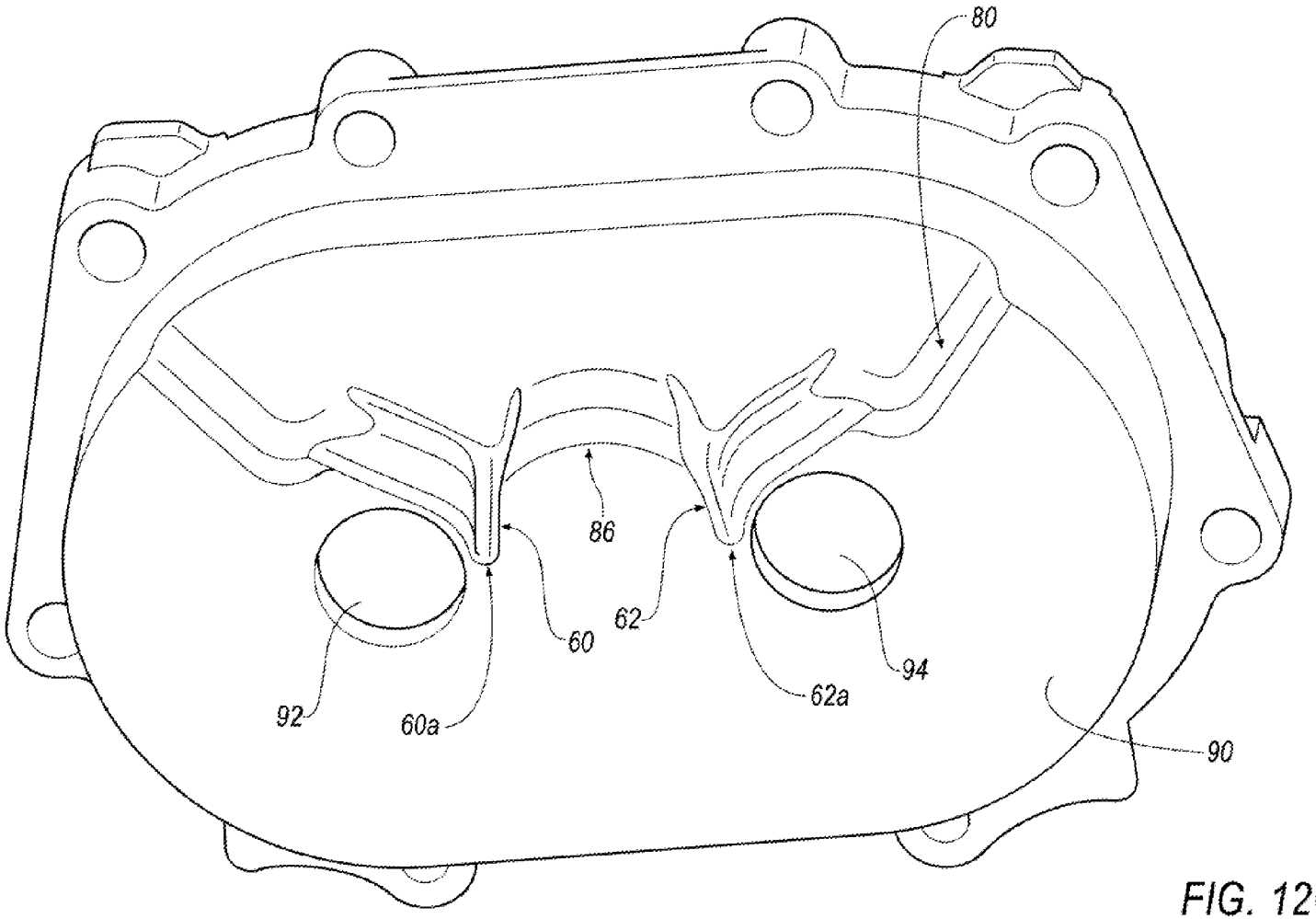
Figure 12D:
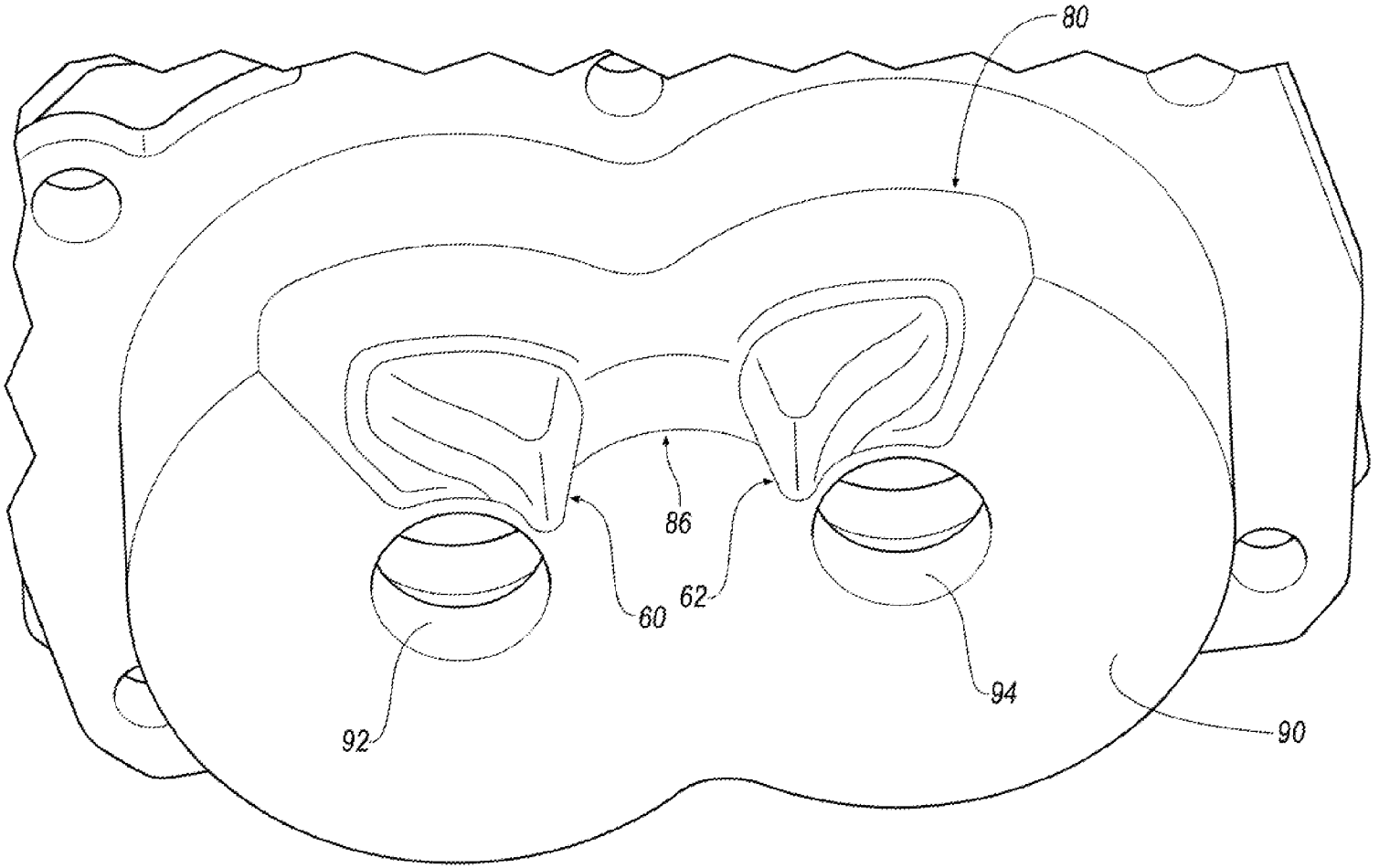

In examples of the present teachings, such as generally illustrated in FIG. 12B, pressure relief ports 60, 62 may include an elongated shape, which may be generally triangular and/or may include a relatively or comparatively small width near the longitudinal axis of a rotor (e.g., rotor 37 and/or rotor 39) and may include a comparatively larger width closer to a top (and/or bottom) portion of blower housing 13. In various examples of the present teachings, such as generally illustrated in FIGS. 12C and 12D, pressure relief ports may include a larger enough width near their respective tops that pressure relief ports extend sufficiently far to impinge on and/or even eliminate curved portions 82, 84. In various aspects of the present teachings, a top width of pressure relief ports 60, 62 may be two, three, or more times greater (e.g., ten or more times) than a lower width of pressure relief ports 60, 62 (e.g., near axes 27*a*, 29*a*). The pressure relief ports 60, 62 may also include generally triangular shapes. Pressure relief ports 60, 62 may include generally rounded portions 60*a*, 62*a*, which may be disposed generally near axes 27*a* and 29*a*, respectively. Pressure relief ports 60, 62 may extend from and/or be in fluid communication with an outlet portion 80 of blower 11.

The pressure relief ports 60, 62 may include one or more of a variety of shapes, size, and configurations. The shape of a pressure relief port may be configured to relieve pressure from high pressure area 70 to outlet portion 80 without permitting fluid communication with inlet 17 and/or other areas that may be in communication with inlet 17 (e.g., may not create "inlet paths"). For example, and without limitation, as generally illustrated in FIGS. 9, 12B, 12C, and 12D, pressure relief ports 60, 62 may include smaller widths near axes 27*a*, 29*a* so that they remain out of fluid communication with inlet paths (e.g., inlet path 74) and so that pressure relief ports 60, 62 may include a greater width nearer outlet portion 80, which may allow for relieved pressure/fluid (e.g., from trapping area 70) to be efficiently exhausted to outlet portion 80.

In examples of the present teachings, blower 11 may include a single pressure relief port or may include a plurality of pressure relief ports, such as, without limitation, a first pressure relief port 60, which may correspond to rotor 37, and/or a second pressure relief port 62, which correspond to rotor 39. A pressure relief port may be configured to be in fluid communication with only one trapping area 70 at any given time and/or for any given rotational position of rotors 37, 39.

In examples of the present teachings, pressure relief ports 60, 62 may be configured to reduce and/or eliminate built up pressure in trapping areas (e.g., trapping area 70). Trapping area 70 may move (e.g., from a location at or near outlet 19 and/or outlet portion 80) toward inlet 17 and may obtain progressively greater pressures before it may ultimately be exposed to inlet 17, if the built up pressure is not reduced and/or eliminated. Exposure of a high pressure trapping area 70 to inlet 17 may create noise as the high pressure fluid may escape through inlet 17. Such noise may be undesirable. A pressure relief port or ports (e.g., relief ports 60, 62) may help reduce undesirable noise.

In examples of the present teachings, outlet portion 80 of blower 11 may be generally disposed at an axial end of the rotors (e.g., at or near end surfaces 47*s*2, 49*s*2) and/or at or near a bearing plate 90 may include outlet portion 80. Outlet portion 80 may be generally disposed in a half of bearing plate 90, which may be an upper half and/or a lower half of the bearing plate 90. Bearing plate 90 and/or outlet portion 80 may be disposed at an axial end opposite an axial end at which inlet 17 may be disposed. Bearing plate 90 may be disposed generally perpendicular to the axes 27*a*, 29*a*. In examples of the present teachings, outlet portion 80 may function and/or be configured as outlet port 19 and/or may be in fluid communication with outlet port 19.

In further examples of the present teachings, outlet portion 80 may include a generally rectangular and/or trapezoidal shape. Outlet portion 80 may include one or more curved portions 82, 84 that may correspond to one or more of axes 27*a*, 29*a* and/or may include a curved portion 86 that may correspond to a central axis 11*a* of blower 11 and/or of blower housing 13. In further examples of the present teachings, central axis 11*a* may coincide with axis A. Pressure relief ports 60, 62 may generally extend from respective curved portions 82, 84 and away from outlet portion 80 and/or curved portions 82, 84 may correspond to rotors 37, 39, respectively. For example, and without limitation, first pressure relief 62 port may extend from first curved portion 82 that may correspond to first rotor 37 and/or second pressure relief port 62 may extend from curved portion 84 that may correspond to second rotor 39.

As generally illustrated in FIG. 12B, the pressure relief ports 60, 62 and/or outlet portion 80 may be machined into and/or formed into bearing plate 90. The depths of pressure relief ports 60, 62 (which may or may not be equal) may generally correspond to a predetermined amount of pressure relief. For example, and without limitation, as generally illustrated in FIGS. 12C and 12D, pressure relief ports 60, 62 may include greater depths in aspects of the present teachings in which it may be desirable to relieve greater amounts of pressure from trapping area 70. Depths of pressure relief ports 60, 62 may not extend all the way through a thickness of the bearing plate and/or may be less than a depth of outlet portion 80. For example, and without limitation, as generally illustrated in FIG. 12B, the depths of pressure relief ports 60, 62 may be about half as deep as outlet portion 80. In other examples of the present teachings, the depths of pressure relief portions 60, 62 may be about as deep as outlet portion 80, such as generally illustrated in FIGS. 12C and 12D. In examples of the present teachings, pressure relief ports 60, 62 may act as diffusors for fluid that is relieved from (e.g., exits) trapping area 70.

The bearing plate 90 may include an aperture 92, which may correspond to axis 27*a*. Bearing plate 90 may be configured to hold an end of a rotor and/or ends of multiple rotors (e.g., rotor 37 and/or rotor 39). The bearing plate 90 may include an aperture for each rotor 37, 39. For example, and without limitation, bearing plate 90 may include first aperture 92 that may correspond to rotor 37 and/or a second aperture 94 that may correspond to rotor 39. Bearing plate 90 may be disposed at the front (e.g., opposite of inlet 17) of the rotors, which may be at an axial end of the rotors.

Figure 13A:
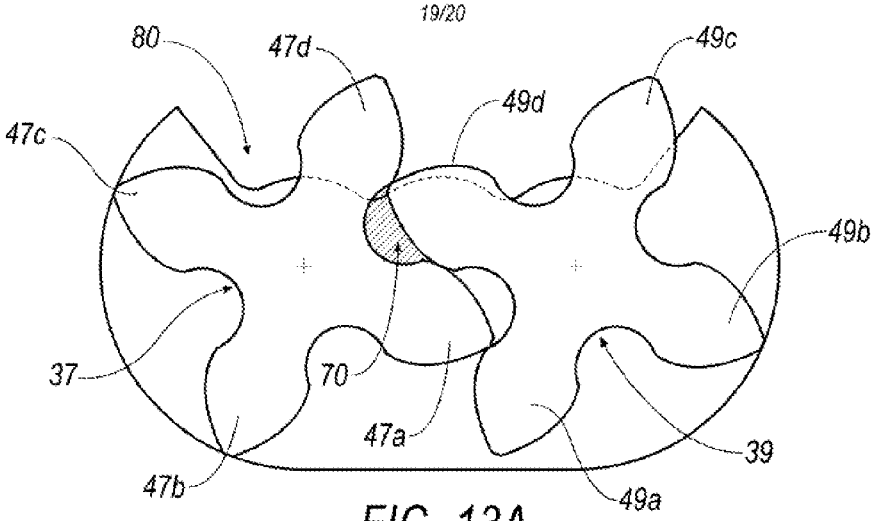
FIG. 13A-13C are diagrammatic views generally representing partial cross-sections of portions of examples of a Roots-type blower in accordance with teachings of the present disclosure.
Figure 13B:
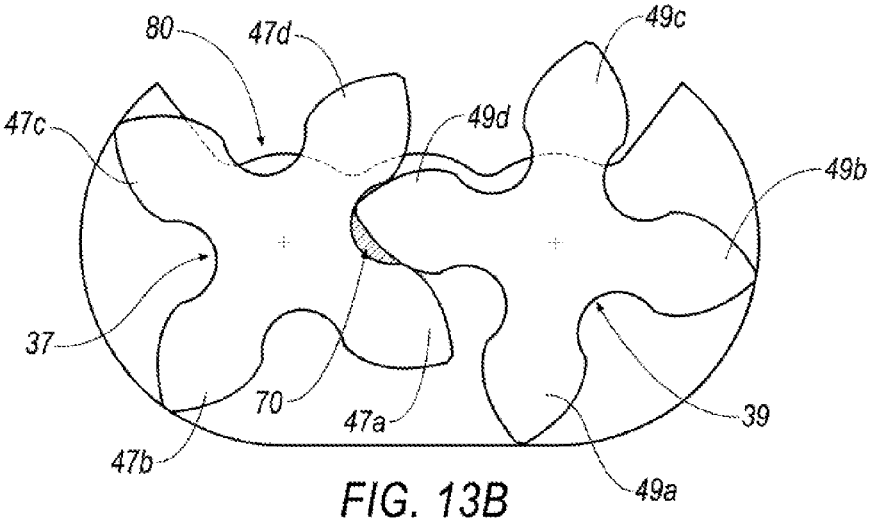
Figure 13C:
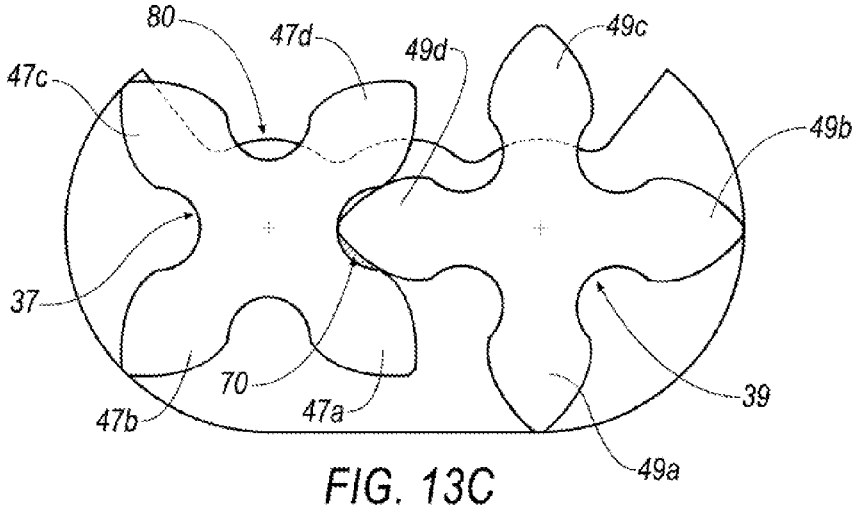

FIGS. 13A-13C generally illustrate three different rotational positions of first rotor 37 and second rotor 39 relative to outlet portion 80 of blower 11. As generally illustrated in FIG. 13A, trapping area 70 may initially be closed off between lobes of the first and second rotors and may include a first volume and a first pressure. As rotors 37, 39 rotate, as generally illustrated in FIGS. 13B and 13C, the volume of trapping area 70 may decrease, which may compress fluid in trapping area 70 and may result in a high pressure trapping area 70. FIG. 13B generally illustrates trapping area 70 including a second volume, which may be smaller than the first volume, that may be at a second pressure, which may be greater than the first pressure. FIG. 13C generally illustrates trapping area 70 including a third volume, which may be smaller than the first and second volumes, that may be a third pressure, which may be greater than the first and second pressures.

Figure 14A:
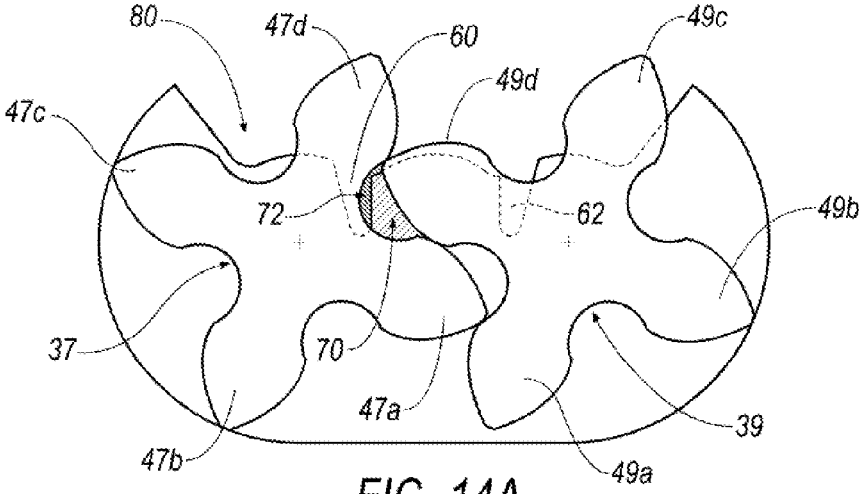
FIG. 14A-14C are diagrammatic views generally representing partial cross-sections of portions of examples of a Roots-type blower in accordance with teachings of the present disclosure.
Figure 14B:
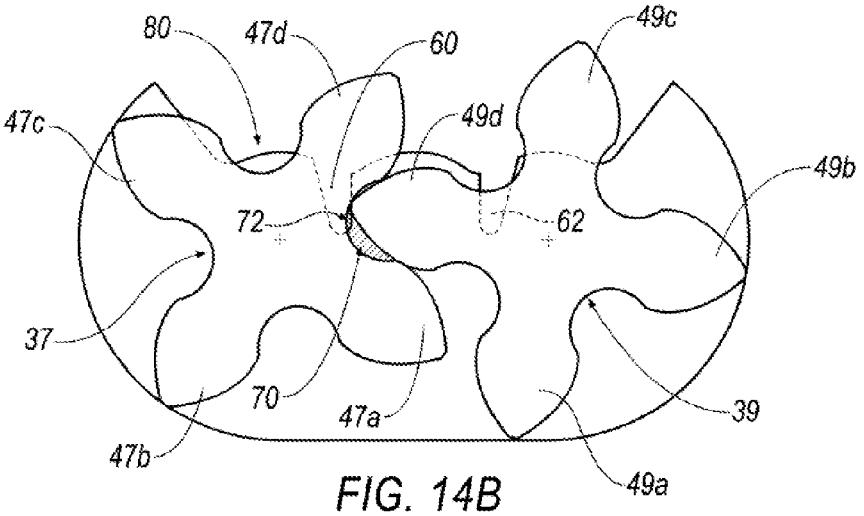
Figure 14C:
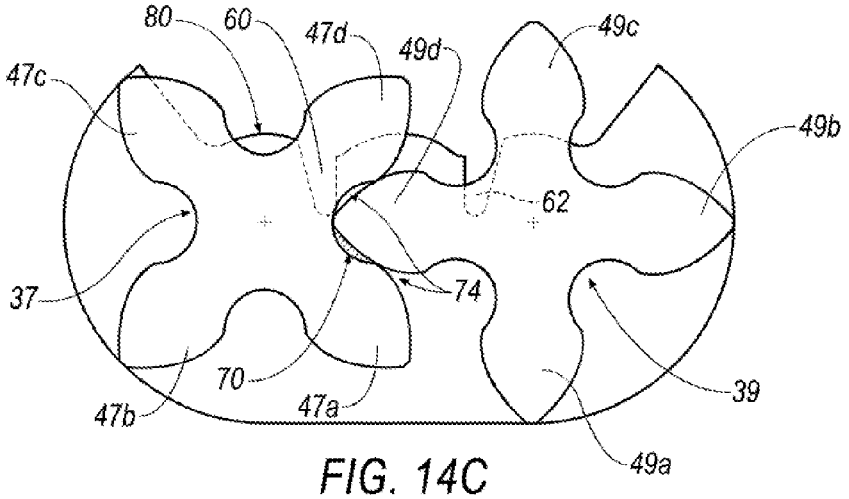

FIGS. 13A-13C generally illustrate three rotational positions of first and second rotors 37, 39 that may generally correspond to the positions of FIGS. 13A-13C. As generally illustrated in FIG. 14A, an overlap area 72 may be present, and may correspond to an overlap of trapping area 70 with a pressure relief port (e.g., pressure relief port 60). Overlap area 72 may permit fluid communication between trapping area 70 with the outlet portion 80, which may reduce pressure in trapping area 70. In various examples of the present teachings, the pressure of trapping area 70 may remain relatively constant across the rotational positions generally shown in FIGS. 14A-14C, which may be in spite of smaller volumes of trapping area 70. The pressure of a trapping area 70 may be shown to increase modestly as rotors 37, 39, rotate but pressure relief ports 60, 62 may limit the increase so that the increase may be relatively insignificant compared to examples of the present teachings without a pressure relief port or ports. The pressure relief ports 60, 62 may effectively prevent trapping area 70 from actually becoming trapped, for example, by providing fluid communication to outlet portion 80.

The foregoing descriptions of specific examples of the present teachings of the present disclosure have been presented for purposes of illustration and description. They are not intended to be exhaustive or to limit the teachings to the precise forms disclosed, and various modifications and variations are possible in light of the above teaching. It is believed that various alterations and modifications of the exemplary aspects of the present teachings may become apparent to those skilled in the art from a reading and understanding of the specification. It is intended that all such alterations and modifications are included in the present disclosure, insofar as they come within the scope of the invention be defined by the claims appended hereto and their equivalents.

What is claimed is:

1. A roots blower, comprising:
- a housing, including;
  - a bearing plate;
  - an outlet portion disposed in the bearing plate and extending to an outer edge of the bearing plate; and
  - an inlet port;
- a first rotor disposed in the housing;
- a second rotor disposed in the housing; and
- a pressure relief port disposed inside the housing and in fluid communication with the outlet portion; further comprising a fluid trapping area between the first and second rotors; and wherein the pressure relief port is configured to relieve fluid pressure from the fluid trapping area to the outlet portion.

2. The roots blower of claim 1, wherein the pressure relief port is configured to provide fluid communication between the fluid trapping area and the outlet portion without providing fluid communication between the outlet portion and the inlet port.

3. The roots blower of claim 1, wherein a volume of the trapping area decreases as the trapping area moves toward the inlet port.

4. The roots blower of claim 1, wherein the trapping area is configured to move from a first location proximate the outlet portion to a second location proximate the inlet port.

5. The roots blower of claim 1, wherein the trapping area is created proximate the outlet portion via a mesh of the first and second rotors.

6. The roots blower of claim 1, wherein the bearing plate is disposed at a first axial end of the first and second rotors, wherein the inlet port is disposed at a second axial end of the first and second rotors.

7. The roots blower of claim 1, wherein the outlet portion includes a first tapered side wall extending from the outer edge of the bearing plate and a second tapered side wall extending from the outer edge of the bearing plate.

8. The roots blower of claim 1, and a depth of the pressure relief port is less than a depth of the outlet portion.

9. The roots blower of claim 8, wherein the outlet portion defines a substantially trapezoidal shape.

10. The roots blower of claim 1, wherein the pressure relief port is a first pressure relief portion; the roots blower includes a second pressure relief portion; the first pressure relief port corresponds to the first rotor; and the second pressure relief port corresponds to the second rotor.

11. The roots blower of claim 1, wherein the pressure relief port defines a substantially triangular shape and is disposed substantially perpendicular to longitudinal axes of the first and second rotors.

12. The roots blower of claim 1, wherein the outlet portion extends laterally outward beyond a central axis of the first rotor and laterally outward beyond a central axis of the second rotor.

13. The roots blower of claim 1, wherein the outlet portion includes a first curved portion aligned vertically with a center of the first rotor, a second curved portion aligned vertically with a center of the second rotor, and a third curved portion disposed between and horizontally aligned with the first curved portion and the second curved portion.

14. A method of operating a roots blower, the method comprising:

providing a housing defining an outlet portion and an inlet port, the housing containing a first rotor, a second rotor, and a pressure relief port in fluid communication with the outlet portion and disposed inside the housing, the pressure relief port extending from the outlet portion;

rotating the first rotor and the second rotor to create a fluid trapping area between the first rotor and the second rotor; and relieving fluid pressure from the fluid trapping area to the outlet portion via the pressure relief port;

wherein the housing includes a bearing plate and the outlet portion is disposed in and extends to an outer edge of the bearing plate.

15. The method of claim 14, wherein said relieving fluid pressure from the trapping area reduces noise generated by the roots blower.

16. The method of claim 14, wherein the trapping area overlaps with the pressure relief port in at least one position of the first and second rotors.

17. The method of claim 14, wherein the pressure relief port is disposed in a bearing plate and the bearing plate is disposed at an axial end of the housing opposite of the inlet port.

18. The method of claim 17, wherein the outlet portion is in fluid communication with a radial outlet port.

* * * * *